US009437961B1

(12) United States Patent
Smajda

(10) Patent No.: US 9,437,961 B1
(45) Date of Patent: Sep. 6, 2016

(54) TWO MATING ELECTRICAL POWER CONNECTOR ASSEMBLIES HAVING IDENTICAL CONFIGURATIONS

(71) Applicant: Westinghouse Air Brake Technologies Corporation, Wilmerding, PA (US)

(72) Inventor: Kenneth J. Smajda, Elkridge, MD (US)

(73) Assignee: Westinghouse Air Brake Technologies Corporation, Wilmerding, PA (US)

( * ) Notice: Subject to any disclaimer, the term of this patent is extended or adjusted under 35 U.S.C. 154(b) by 0 days.

(21) Appl. No.: 14/873,562

(22) Filed: Oct. 2, 2015

(51) Int. Cl.
*H01R 13/28* (2006.01)
*H01R 13/52* (2006.01)
*H01R 43/16* (2006.01)

(52) U.S. Cl.
CPC ..... *H01R 13/5219* (2013.01); *H01R 13/28* (2013.01); *H01R 43/16* (2013.01)

(58) Field of Classification Search
CPC ..... H01R 13/27; H01R 13/213
USPC ..... 439/284, 286, 290
See application file for complete search history.

(56) References Cited

U.S. PATENT DOCUMENTS 3,252,124 A * 5/1966 Hansen ..... H01R 23/27 439/291
4,695,110 A * 9/1987 Wasserlein ..... H01R 13/28 439/281
4,917,623 A * 4/1990 Grabbe ..... H01R 13/28 439/284
5,118,303 A * 6/1992 LeBaron ..... H01R 23/27 439/286
5,800,196 A 9/1998 Rudoy et al.
5,857,866 A * 1/1999 Felps ..... H01R 13/08 439/289
6,447,319 B1 * 9/2002 Bodin ..... H01R 23/27 439/294
6,881,084 B2 * 4/2005 Crossan ..... G02B 6/383 439/284
6,997,731 B1 * 2/2006 Wood ..... H01R 13/623 439/294
2003/0013337 A1 * 1/2003 Crossan ..... G02B 6/383 439/284

* cited by examiner

*Primary Examiner* — Chandrika Prasad
(74) *Attorney, Agent, or Firm* — The Webb Law Firm

(57) ABSTRACT

An electrical power connector assembly includes a body having a housing portion and a connection portion; a coupling ring rotatably disposed on the body; and a power connector disposed within the housing portion of the body. The power connector is configured to form a mating engagement with another power connector having the same configuration. The coupling ring is configured to engage a connection portion of another electrical power connector assembly having the same configuration and the connection portion of the body is configured to be engaged by a coupling ring of the other electrical power connector assembly. The coupling ring and the connection portion of the body are configured to engage the connection portion and the coupling ring of the other electrical power connector assembly, respectively, to bring the power connectors together to complete the mating engagement between the power connectors.

20 Claims, 19 Drawing Sheets

TWO MATING ELECTRICAL POWER CONNECTOR ASSEMBLIES HAVING IDENTICAL CONFIGURATIONS

BACKGROUND OF THE INVENTION

1. Field of the Invention

The present invention relates generally to a power connector for rail applications, such as for connecting power lines between rail cars in a train. In particular, the present invention relates to a hermaphroditic electrical power connector assembly that is configured to mate with an assembly having a substantially identical configuration and containing a hermaphroditic power connector or coupling.

2. Description of Related Art

Hermaphroditic power connectors, i.e., power connectors configured to mate with a power connector having an identical or substantially identical configuration, for use in rail applications are generally known in the art. An example of such a hermaphroditic power connector is disclosed in U.S. Pat. No. 5,800,196, which is hereby incorporated by reference in its entirety.

The use of a hermaphroditic power connector allows one connector to interface with the same type of connector, which is desirable in car to car rail applications. Current connector systems used in the rail industry rely upon the operator to manually push and pull apart the connectors to mate/un-mate them. This generally requires a lot of force to operate the connectors and is not comfortable for the operator to use. Also, current systems are not fully sealed against water/dirt which causes mating and un-mating difficulties, as well as electrical connection failures. In current connector systems, the polarity is crossed at each connection, which does not affect use of the systems in rail applications, but does limit use of these systems in other applications and does not allow for the connectors of these systems to be used as general power connectors, which must maintain polarity through the contacts.

Accordingly, there is a general need in the art for a hermaphroditic power connector for rail applications that is simpler to handle and requires less force to mate and un-mate, and also fully seals the electrical connection and mating surfaces.

SUMMARY OF THE INVENTION

Generally, provided is an improved hermaphroditic electrical power connector assembly, system, and method. Preferably, provided is an electrical power connector assembly, system, and method that provide a mechanical advantage to an operator to mate and un-mate the connectors and is easy for the operator to grip and handle. Preferably, provided is an electrical power connector assembly, system, and method that provide a sealed environment for the electrical connection and the mating surfaces when the connectors are mated. Preferably, provided is an electrical power connector assembly, system, and method that may be utilized in ECP railcar to railcar connections and also in general power connection applications for harsh environments.

Therefore, in one preferred and non-limiting embodiment or aspect, provided is a hermaphroditic electrical power connector assembly that utilizes a bayonet-style coupling ring to mate and un-mate the assembly via a twist action. The coupling rings of two connectors are rotated opposite to each other to mate and un-mate the connectors. This provides a mechanical advantage to the operator, which will allow the operator to mate and un-mate the connectors easily and in all weather conditions. An overmolded polymer feature on the coupling rings provides a comfortable grip and improves the grip when the connectors are wet. Each coupling ring may also be provided with a lip seal on its forward end to provide a complete seal of the connectors when mated and a seal of the mating surfaces. One or more visual indicators on the coupling ring may be provided, such that the operator can easily determine that the connectors are properly mated or in the correct position to allow mating.

In one preferred and non-limiting embodiment or aspect, an internal flat spring mounted pin on the coupling ring allows the connector to pull apart from its mated condition should a significant force be applied to a lanyard pin attached to the back of the connector. When mated, this coupling pin sits in a hole with a slight draft angle on one wall. Two pins, one per each connector, may be used to couple the connectors. When enough force is applied to the connectors, the pin will ride up the side of the hole and allow the connectors to separate. This feature is beneficial for car break part operations that occur in the rail environment. In particular, should the railcars separate, the connectors will un-mate without being damaged.

In one preferred and non-limiting embodiment or aspect, a face seal is provided around the connector contacts. This secondary seal provide a backup to the lip seal on the coupling ring to keep the contacts clean and dry, as well as provide the force necessary to keep the coupling pins in the lock position.

In one preferred and non-limiting embodiment or aspect, flat blade contacts are used, which clean the contact surfaces every time they mate. This configuration also keeps the polarity correct should they be used as a standard power system where polarity needs to be maintained through the connection.

In accordance with one preferred and non-limiting embodiment or aspect of the present invention, an electrical power connector assembly is provided. The assembly includes a body having a housing portion and a connection portion; a coupling ring rotatably disposed on the body; and a power connector disposed within the housing portion of the body. The power connector is configured to form a mating engagement with another power connector having the same configuration. The coupling ring is configured to engage a connection portion of another electrical power connector assembly having the same configuration and the connection portion of the body is configured to be engaged by a coupling ring of the other electrical power connector assembly having the same configuration. The coupling ring and the connection portion of the body are configured to engage the connection portion of the body and the coupling ring of the other electrical power connector assembly, respectively, to bring the power connector together with the power connector of the other electrical power connector assembly to complete the mating engagement between the power connectors.

According to the preferred and non-limiting embodiment or aspect, the coupling ring is rotatable on the body between a release position in which the coupling ring is configured to allow the connection portion of the other electrical power assembly to be disengaged from the coupling ring and a lock position in which the coupling ring is configured to lock the connection portion of the other electrical power connector assembly in engagement with the coupling ring. The coupling ring may include a coupling pin extending from an inner surface thereof and the connection portion includes a groove defined therein. The coupling pin of the coupling ring is configured to slidingly engage the groove of the connection portion of the other electrical power connector assembly to bring the power connector together with the power connector of the other electrical power connector assembly as the coupling ring is moved from the release position to the lock position to complete the mating engagement between the power connectors. The coupling pin of the coupling ring may be biased to extend radially inwardly away from the inner surface of the coupling ring and the groove of the connection portion of the body terminates in a hole having an angled sidewall, and the coupling pin may be configured to retract toward the inner surface of the coupling ring when engaged with the angled sidewall of the hole of the other electrical power connector assembly to allow the electrical power connector assembly to be disengaged from the other electrical power connector assembly without moving the coupling ring to the release position. The coupling ring may further include a flat spring for biasing the coupling pin, the flat spring being disposed on an outer surface of the coupling ring, and a cover disposed on the outer surface of the coupling ring over the flat spring.

In one preferred and non-limiting embodiment or aspect, the coupling ring may include at least one indicator configured to provide a visual indication of a position of the coupling ring with respect to the release position and the lock position. The at least one indicator may include a plurality of reflective inserts disposed on the coupling ring. The plurality of reflective inserts are configured to align with respective reflective inserts disposed on the coupling ring of the other electrical power connector assembly when the coupling ring is in a lock position.

According to the preferred and non-limiting embodiment or aspect, the body includes a rotation stop to limit rotation of the coupling ring on the body past the release position and the lock position. The coupling ring includes a lip seal disposed on an end thereof. The lip seal is configured to form a sealing engagement with the lip seal of the coupling ring of the other electrical power connector assembly. The lip seal may be removably connected to the coupling ring. The lip seal may include a gasket molded on a ring having inwardly extending protrusions and the coupling ring includes a channel defined adjacent to the end thereof. The protrusions of the ring of the lip seal are configured to releasably engage the channel to removably connect the lip seal to the coupling ring.

In one preferred and non-limiting embodiment or aspect, the housing portion of the body may include a face seal gasket disposed on an end of the housing portion of the body around the power connector. The face seal gasket is configured to form a sealing engagement with the face seal gasket of the housing portion of the body of the other electrical power connector assembly. The coupling ring may be disposed on the body in a position surrounding at least a portion of the housing portion of the body. The connection portion of the body extends from the housing portion and may have a crescent shape corresponding to a shape of the coupling ring.

According to the preferred and non-limiting embodiment or aspect, the coupling ring includes an overmolded polymer coating configured to facilitate handling of the coupling ring. The body also includes a rear section configured to maintain and seal a connection between the power connector and a power cable extending from a rear of the electrical power connector assembly. The rear section includes a nut and a gland seal disposed within the nut, the nut and gland seal being configured to secure the power cable to the body. The rear section also includes a rear boot extending over at least a portion of the body, the nut, and the gland seal.

According to another preferred and non-limiting embodiment or aspect of the present invention, an electrical power connection system is provided. The system includes at least two substantially identical electrical power connector assemblies. Each assembly includes a body having a housing portion and a connection portion; a coupling ring rotatably disposed on the body; and a power connector disposed within the housing portion of the body. The power connectors are substantially identical and each of the power connectors is configured to form a mating engagement with the other. The coupling ring of each of the electrical power connector assemblies is configured to engage the connection portion of the other electrical power connector assembly and the connection portion of each of the electrical power connector assemblies is configured to be engaged by the coupling ring of the other electrical power connector assembly. The coupling rings of both electrical power connector assemblies mate with the respective connection portions to bring the power connectors together to complete the mating engagement between the power connectors.

According to another preferred and non-limiting embodiment or aspect of the present invention, a method of coupling electrical power connector assemblies is provided. The method includes providing at least two substantially identical electrical power connector assemblies. Each assembly includes a body having a housing portion and a connection portion; a coupling ring rotatably disposed on the body, the coupling ring being rotatable on the body to a lock position; and a power connector disposed within the housing portion of the body. The power connectors are substantially identical and each of the power connectors is configured to form a mating engagement with the other. The method further includes aligning the at least two electrical power connector assemblies and pressing them together such that the coupling ring of each of the electrical power connector assemblies engages the connection portion of the other electrical power connector assembly and the connection portion of each of the electrical power connector assemblies is engaged by the coupling ring of the other electrical power connector assembly; and rotating each of the coupling rings to the lock position to mate with the coupling rings with the respective connection portions to bring the power connectors together to complete the mating engagement between the power connectors.

Further preferred and non-limiting embodiments or aspects or aspects will now be described in the following numbered clauses.

Clause 1: An electrical power connector assembly, comprising a body comprising a housing portion and a connection portion; a coupling ring rotatably disposed on the body; and a power connector disposed within the housing portion of the body, the power connector being configured to form a mating engagement with another power connector having the same configuration, wherein the coupling ring is configured to engage a connection portion of another electrical power connector assembly having the same configuration and the connection portion of the body is configured to be engaged by a coupling ring of the other electrical power connector assembly having the same configuration, and wherein the coupling ring and the connection portion of the body are configured to engage the connection portion of the body and the coupling ring of the other electrical power connector assembly, respectively, to bring the power connector together with the power connector of the other electrical power connector assembly to complete the mating engagement between the power connectors.

Clause 2: The electrical power connector assembly according to clause 1, wherein the coupling ring is rotatable on the body between a release position in which the coupling ring is configured to allow the connection portion of the other electrical power assembly to be disengaged from the coupling ring and a lock position in which the coupling ring is configured to lock the connection portion of the other electrical power connector assembly in engagement with the coupling ring.

Clause 3: The electrical power connector assembly according to clause 2, wherein the coupling ring includes a coupling pin extending from an inner surface thereof and the connection portion includes a groove defined therein, and wherein the coupling pin of the coupling ring is configured to slidingly engage the groove of the connection portion of the other electrical power connector assembly to bring the power connector together with the power connector of the other electrical power connector assembly as the coupling ring is moved from the release position to the lock position to complete the mating engagement between the power connectors.

Clause 4: The electrical power connector assembly according to clause 3, wherein the coupling pin of the coupling ring is biased to extend radially inwardly away from the inner surface of the coupling ring, and the groove of the connection portion of the body terminates in a hole having an angled sidewall, and wherein the coupling pin is configured to retract toward the inner surface of the coupling ring when engaged with the angled sidewall of the hole of the other electrical power connector assembly to allow the electrical power connector assembly to be disengaged from the other electrical power connector assembly without moving the coupling ring to the release position.

Clause 5: The electrical power connector assembly according to clause 4, wherein the coupling ring further comprises a flat spring for biasing the coupling pin, the flat spring being disposed on an outer surface of the coupling ring, and a cover disposed on the outer surface of the coupling ring over the flat spring.

Clause 6: The electrical power connector assembly according to any one of clauses 2-5, wherein the coupling ring includes at least one indicator configured to provide a visual indication of a position of the coupling ring with respect to the release position and the lock position.

Clause 7: The electrical power connector assembly according to clause 6, wherein the at least one indicator comprises a plurality of reflective inserts disposed on the coupling ring, and wherein the plurality of reflective inserts are configured to align with respective reflective inserts disposed on the coupling ring of the other electrical power connector assembly when the coupling ring is in a lock position.

Clause 8: The electrical power connector assembly according to any one of clauses 2-7, wherein the body includes a rotation stop to limit rotation of the coupling ring on the body past the release position and the lock position.

Clause 9: The electrical power connector assembly according to any one of clauses 1-8, wherein the coupling ring includes a lip seal disposed on an end thereof, and wherein the lip seal is configured to form a sealing engagement with the lip seal of the coupling ring of the other electrical power connector assembly.

Clause 10: The electrical power connector assembly according to clause 9, wherein the lip seal is removably connected to the coupling ring.

Clause 11: The electrical power connector assembly according to clause 10, wherein the lip seal comprises a gasket molded on a ring having inwardly extending protrusions and the coupling ring includes a channel defined adjacent to the end thereof, and wherein the protrusions of the ring of the lip seal are configured to releasably engage the channel to removably connect the lip seal to the coupling ring.

Clause 12: The electrical power connector assembly according to any one of clauses 1-11, wherein the housing portion of the body includes a face seal gasket disposed on an end of the housing portion of the body around the power connector, and wherein the face seal gasket is configured to form a sealing engagement with the face seal gasket of the housing portion of the body of the other electrical power connector assembly.

Clause 13: The electrical power connector assembly according to any one of clauses 1-12, wherein the coupling ring is disposed on the body in a position surrounding at least a portion of the housing portion of the body.

Clause 14: The electrical power connector assembly according to clause 13, wherein the connection portion of the body extends from the housing portion and has a crescent shape corresponding to a shape of the coupling ring.

Clause 15: The electrical power connector assembly according to any one of clauses 1-14, wherein the coupling ring comprises an overmolded polymer coating configured to facilitate handling of the coupling ring.

Clause 16: The electrical power connector assembly according to any one of clauses 1-15, wherein the body further comprises a rear section configured to maintain and seal a connection between the power connector and a power cable extending from a rear of the electrical power connector assembly.

Clause 17: The electrical power connector assembly according to clause 16, wherein the rear section comprises a nut and a gland seal disposed within the nut, the nut and gland seal being configured to secure the power cable to the body.

Clause 18: The electrical power connector assembly according to clause 17, wherein the rear section further comprises a rear boot extending over at least a portion of the body, the nut, and the gland seal.

Clause 19: An electrical power connection system, comprising at least two substantially identical electrical power connector assemblies, each assembly being an electrical power connector assembly according to any one of clauses 1-18 or comprising a body comprising a housing portion and a connection portion; a coupling ring rotatably disposed on the body; and a power connector disposed within the housing portion of the body, wherein the power connectors are substantially identical and each of the power connectors is configured to form a mating engagement with the other, wherein the coupling ring of each of the electrical power connector assemblies is configured to engage the connection portion of the other electrical power connector assembly and the connection portion of each of the electrical power connector assemblies is configured to be engaged by the coupling ring of the other electrical power connector assembly, and wherein the coupling rings of both electrical power connector assemblies matingly engage the respective connection portions to bring the power connectors together to complete the mating engagement between the power connectors.

Clause 20: A method of coupling electrical power connector assemblies, comprising providing at least two substantially identical electrical power connector assemblies, each assembly being an electrical power connector assembly according to any one of clauses 1-18 or comprising a body comprising a housing portion and a connection portion; a coupling ring rotatably disposed on the body, the coupling ring being rotatable on the body to a lock position; and a power connector disposed within the housing portion of the body, wherein the power connectors are substantially identical and each of the power connectors is configured to form a mating engagement with the other; aligning the at least two electrical power connector assemblies and pressing them together such that the coupling ring of each of the electrical power connector assemblies engages the connection portion of the other electrical power connector assembly and the connection portion of each of the electrical power connector assemblies is engaged by the coupling ring of the other electrical power connector assembly; and rotating each of the coupling rings to the lock position to matingly engage the coupling rings with the respective connection portions to bring the power connectors together to complete the mating engagement between the power connectors.

These and other features and characteristics of the present invention, as well as the methods of operation and functions of the related elements of structures, and the combination of parts and economies of manufacture will become more apparent upon consideration of the following description and with reference to the accompanying drawings, all of which form a part of this specification, wherein like reference numerals designate corresponding parts in the various figures. It is to be expressly understood, however, that the drawings are for the purpose of illustration and description only, and are not intended as a definition of the limits of the invention. As used in the specification and the claims, the singular form of "a", "an", and "the" include plural referents unless the context clearly dictates otherwise.

DETAILED DESCRIPTION OF THE INVENTION

Figure 1:
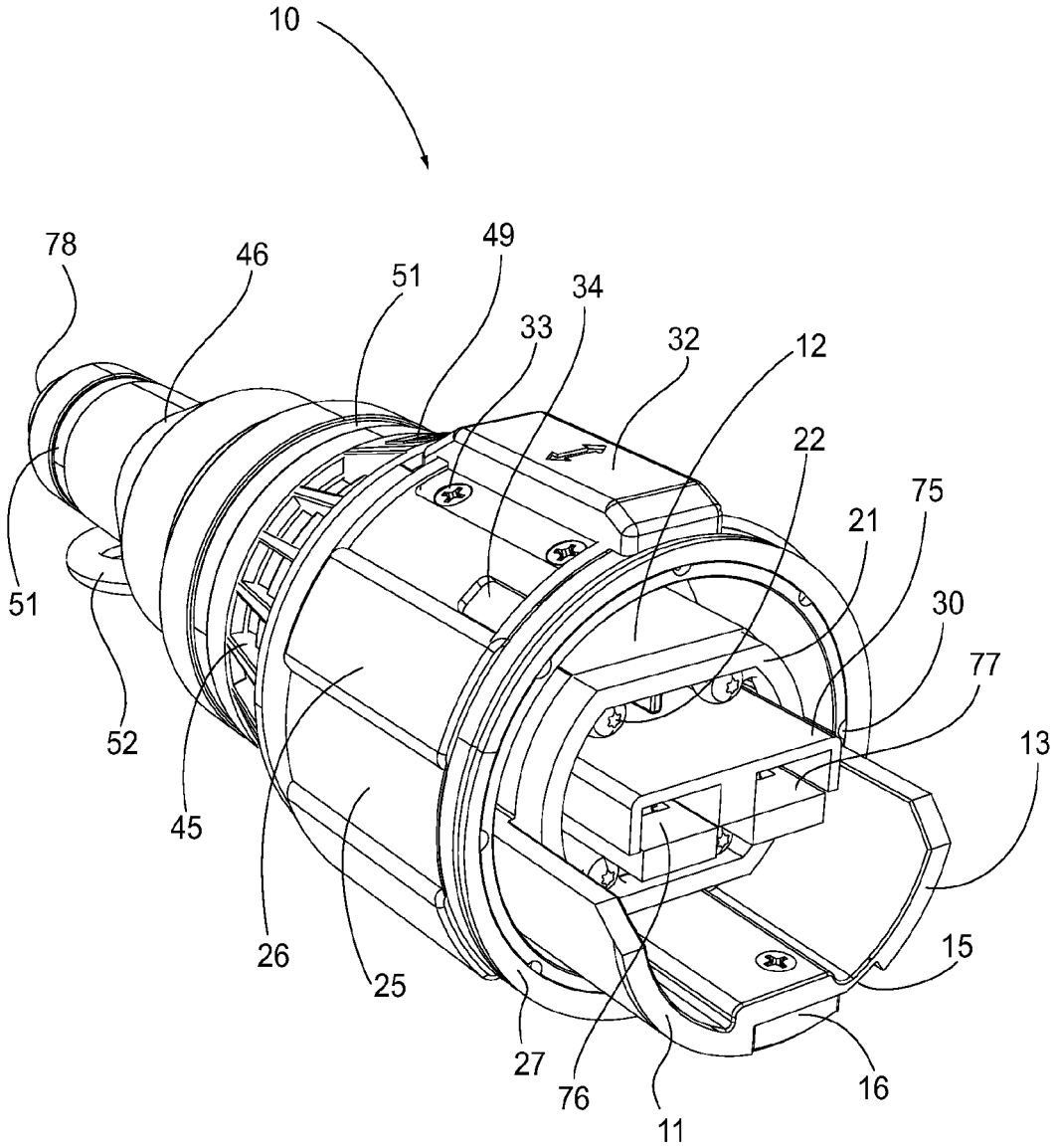
FIG. 1 is an upper perspective view of an electrical power connector assembly according to the principles of the present invention.

For purposes of the description hereinafter, the terms "end", "upper", "lower", "right", "left", "vertical", "horizontal", "top", "bottom", "lateral", "longitudinal", and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments or aspects of the invention. Hence, specific dimensions and other physical characteristics related to the embodiments or aspects disclosed herein are not to be considered as limiting.

With reference to FIGS. 1-14C, a preferred and non-limiting embodiment or aspect of an electrical power connector assembly 10 in accordance with the principles of the present invention is shown. The assembly 10 includes a body having a front section 11 and a rear section 45. The front section 11 of the body includes a housing portion 12 and a connection portion 13. The assembly 10 also includes a coupling ring 25 rotatably disposed on the housing portion 12 of the body and a power connector 75 disposed within the housing portion 12 of the body. The power connector 75 includes the electrical contacts that establish the electrical connection between the assembly 10 and another assembly 10 of an identical or substantially identical configuration. To that end, the power connector 75 is configured to form a mating engagement with another power connector having the same or substantially the same configuration as the power connector 75. According to a particular embodiment or aspect of the invention, the front section 11 and the rear section 45 of the body are both made from injection molded plastic, although it is to be appreciated that the body may be formed from any material and/or according to any manufacturing technique known to be suitable to those having ordinary skill in the art.

Figure 14A:
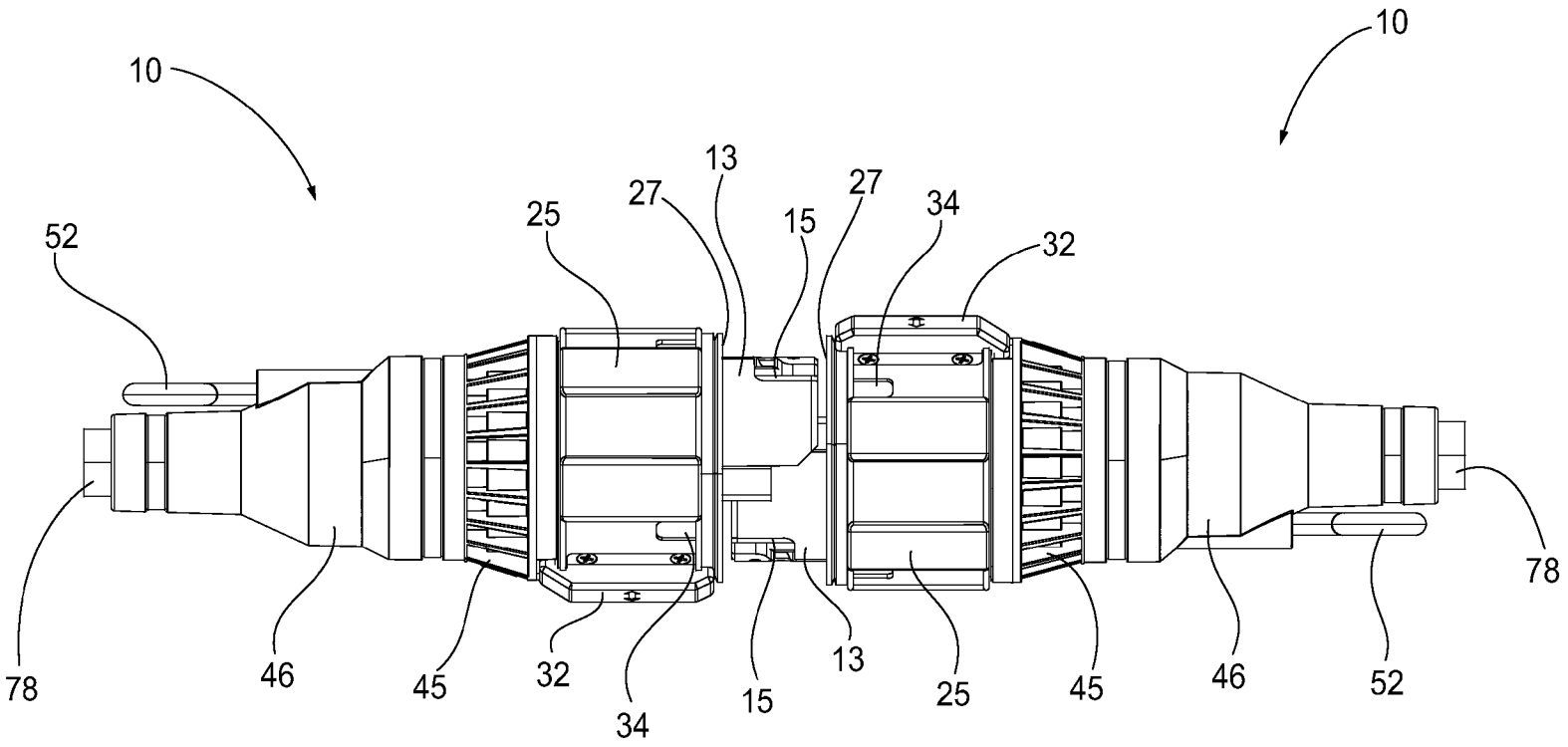
FIG. 14A is a side view of two of the assemblies of FIG. 1 in an aligned position prior to mating.
Figure 14B:
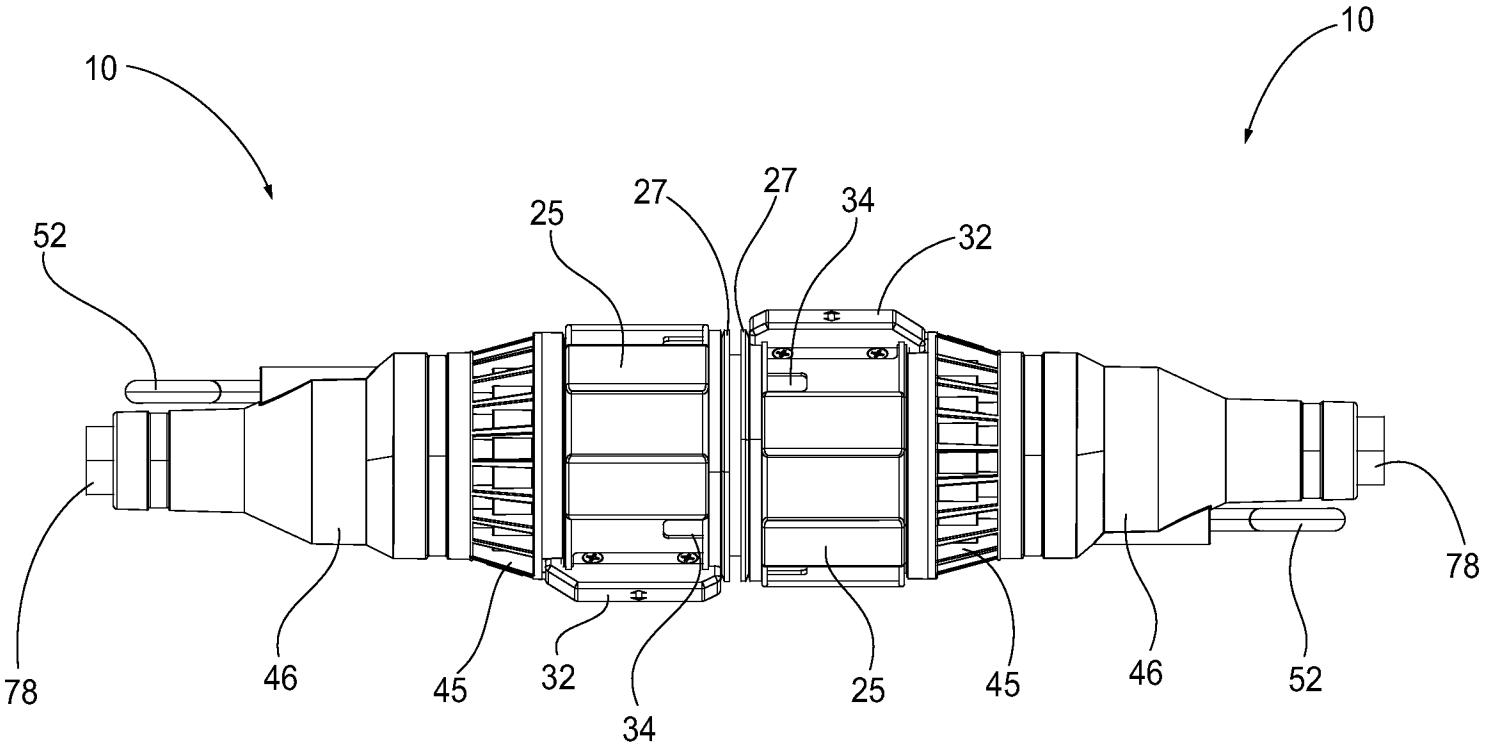
FIG. 14B is a side view of two of the assemblies of FIG. 1 in a partially-mated position.
Figure 14C:
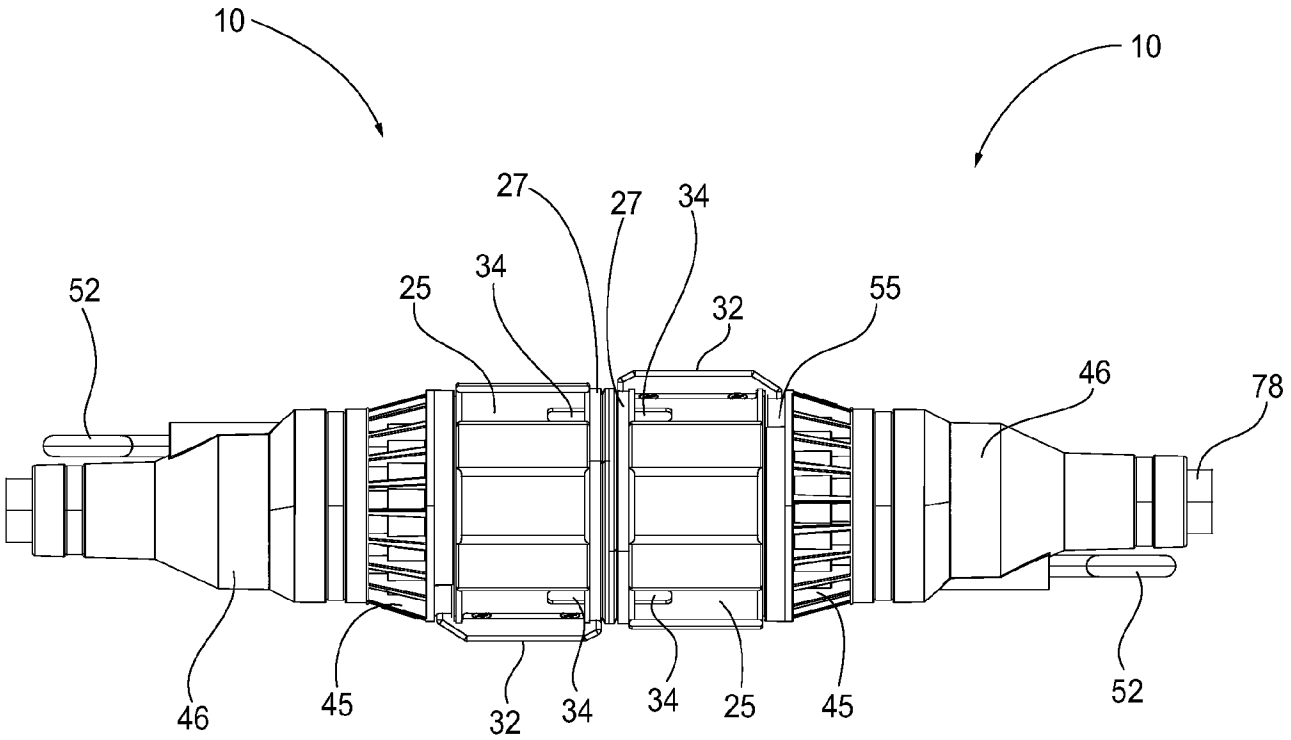
FIG. 14C is a side view of two of the assemblies of FIG. 1 in a fully mated and locked position.

As can be appreciated from FIGS. 14A-14C, the electrical power connector assembly 10 is hermaphroditic and is configured to engage and be coupled to another electrical power connector assembly 10 having the same or substantially the same configuration. In particular, the coupling ring 25 is configured to engage the connection portion 13 of the other connector assembly 10 and the connection portion 13 is configured to be engaged by the coupling ring 25 of the other connector assembly 10. The coupling ring 25 and the connection portion 13 are configured to engage the connection portion 13 and the coupling ring 25 of the other connector assembly 10, respectively, to bring the power connector 75 together with the power connector of the other connector assembly 10 to complete the mating engagement between the power connectors. Accordingly, it is to be appreciated that at least two identical or substantially identical connector assemblies 10 or multiple pairs of such connector assemblies 10 may be used to form an electrical power connection system, which can be used to establish ECP railcar to railcar connections in a rail environment or as general power connectors in a harsh or rugged environment.

With reference to FIGS. 1-14C, the coupling ring 25 is rotatable on the housing portion 12 of the body between a release position, shown in FIGS. 14A and 14B, and a lock position, shown in FIG. 14C. In the release position, the coupling ring 25 is configured to allow the connection portion 13 of the body of the other connector assembly 10 to be disengaged from the coupling ring 25. In the lock position, the coupling ring 25 is configured to lock the connection portion 13 of the body of the other connector assembly 10 in engagement with the coupling ring 25. In this manner, the engagement of the coupling rings 25 and the connection portions 13 of the connector assemblies 10 forms a bayonet-style coupling mechanism, wherein the connector assemblies 10 can be mated and un-mated via twisting action. As will be discussed in further detail below, this type of coupling allows for mechanical advantage to be provided to the operator with respect to both mating and un-mating the connector assemblies 10 and also allows for a more secure seal to be provided at a point of abutment between the coupling rings 25 of the mated connector assemblies 10.

As shown in FIGS. 1-14C, the front section 11 of the body is formed with a cylindrical or substantially cylindrical shape in order to rotatably support the coupling ring 25 thereon. The coupling ring 25 is disposed on the front section 11 of the body in a position surrounding at least a portion of the housing portion 12. The housing portion 12 is also formed to include an interior cavity that is complementary to the shape of the power connector 75 so that the power connector 75 may be tightly secured within the housing portion 12. The connection portion 13 of the front section 11 extends from the housing portion 12 and has a crescent shape so as to correspond to the interior shape of the coupling ring 25. A channel 14 is formed in the front section 11 of the body, in which a strike plate 16 is mounted. The strike plate 16 extends along the length of the front section 11 from the front edge of the connection portion 13 towards the rear of the housing portion 12. The strike plate 16 provides structural support to the front section 11 of the body and also provides a more rigid structure for establishing the bayonet-style coupling and for the interconnection of certain other components of the assembly 10 to the front section 11, as will be discussed further below. The strike plate 16 has rounded corners at the front to prevent injury to the operator and to prevent gouging of a coupling pin 35 on the coupling ring 25. The strike plate 16 is fastened to the front section 11 of the body via one or more screws 20, shown in FIG. 11. The screws 20 may be provided with one or more sealing gaskets (not shown) to seal the connection between the strike plate 16 and the front section 11 to prevent the infiltration of moisture into the interior of the front section 11. According to a particular embodiment or aspect of the invention, the strike plate 16 is formed from 304 stainless steel to prevent corrosion, although it is to be appreciated that the strike plate 16 may be formed from any material and/or according to any manufacturing technique known to be suitable to those having ordinary skill in the art.

Figure 8:
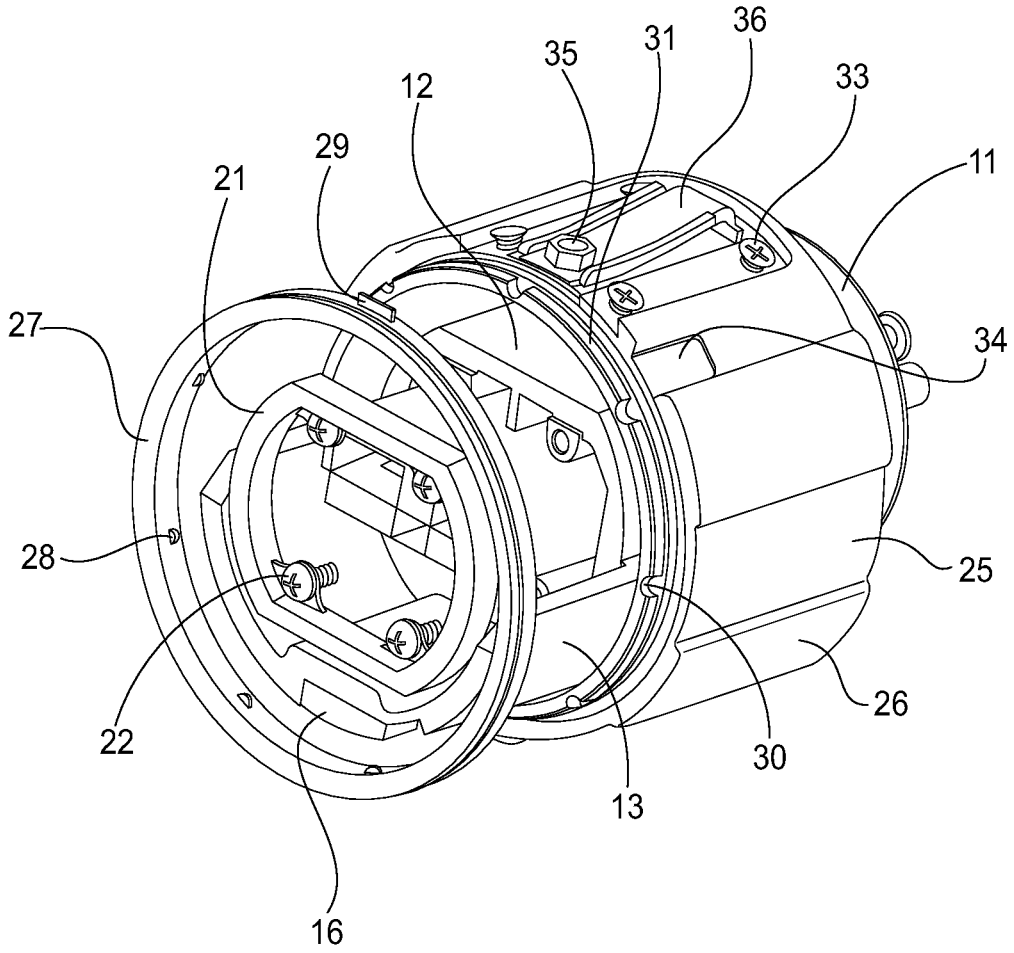
FIG. 8 is an exploded perspective view of portions of the assembly of FIG. 1 illustrating certain interior details of the assembly.
Figure 10:
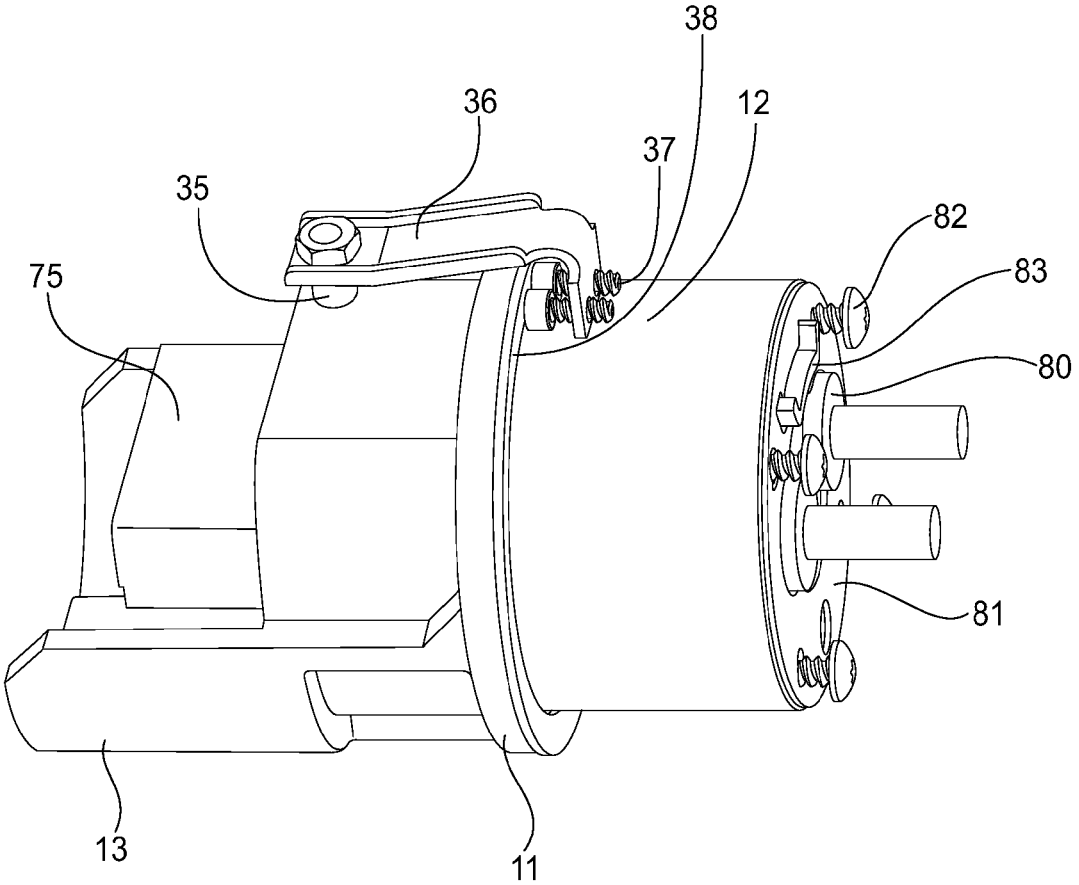
FIG. 10 is a perspective view of portions of the assembly of FIG. 1 illustrating certain interior details of the assembly.
Figure 11:
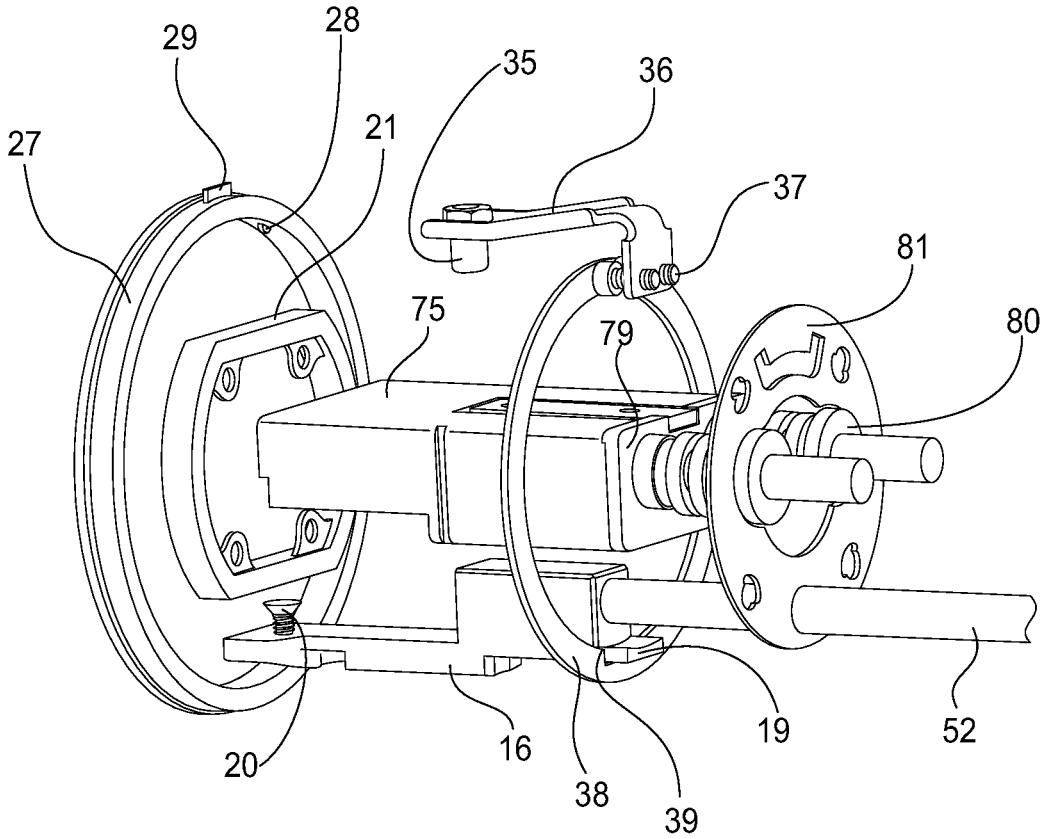
FIG. 11 is an exploded perspective view of portions of the assembly of FIG. 1 illustrating certain interior details of the assembly.

As shown in FIGS. 8, 10, and 11, the coupling ring 25 is rotatably supported on the front section 11 of the body by a coupling ring washer 38 that surrounds the housing portion 12. The housing portion 12 is shaped to help retain the coupling ring washer 38 in a fixed position on the body. The coupling ring washer 38, which may be made from stainless steel, includes a cut out portion 39 at the bottom of the washer 38. The strike plate 16 includes a rear protrusion 19 that extends rearwardly to engage the cut out portion 39 of the washer 38. The coupling ring washer 38 and, thus, the coupling ring 25 can be rotated with respect to the body between the positions wherein the ends of the cut out portion 39 come into engagement with the rear protrusion 19 of the strike plate 16. In this manner, the protrusion 19 acts as a rotation stop for the body to limit or prevent rotation of the coupling ring 25 on the body past the release position and the lock position. It is to be appreciated that additional or alternative mechanisms for forming rotation stops on the body of the connector assembly 10 may be utilized.

As shown in FIGS. 2, 3, 5, 7, 8, 10, and 11, the coupling ring 25 includes the coupling pin 35 extending an inner surface of the coupling ring 25 and the connection portion 13 of the body includes a groove 15 defined therein extending from the front edge of the connection portion 13 rearwardly and circumferentially, and terminates in a hole 17 defined in the strike plate 16 at the bottom of the connection portion 13. As shown, the groove 15 is defined in the plastic part of the connection portion 13 and in the strike plate 16. The coupling pin 25 and the groove 15 are so configured that, as the connector assemblies 10 are slid together and mated (as shown in FIGS. 14A-14C), the coupling pin 35 will slidingly engage the groove 15 of the connection portion 13 of the other connector assembly 10. The groove 15 is so configured that, as the coupling ring 25 is rotated from the release position to the lock position, the coupling pin 35 will slide within the groove 15 to draw or bring the power connector 75 together with the power connector 75 of the other connector assembly 10 as the coupling rings 25 are moved from the release position to the lock position to complete the mating engagement between the connector assemblies 10, particularly power connectors 75. According to the embodiment or aspect shown in FIGS. 1-14C, the coupling ring 25 is rotated approximately 30° between the release position and the lock position, although other configurations are possible.

It is to be appreciated that the coupling rings 25 and the connection portions 13 become engaged with each other prior to the coupling rings 25 being rotated to their respective lock positions. As such, power connectors 75 become at least partially engaged with each other and mated to establish an electrical coupling without the coupling rings 25 being rotated to the lock position. According to a particular embodiment or aspect, when the connector assemblies 10 are slid together, prior to rotating the coupling rings 25 to their respective lock positions, a pull apart force of approximately 10 lbs. is necessary to pull the connector assemblies 10 apart. Rotating the coupling rings 25 is necessary to draw the power connectors 75 together into a full mating engagement, to compress the seals on the coupling rings 25 and housing portions 12 together, as will be discussed below, and to lock the connector assemblies 10 together. As can be appreciated from FIGS. 2, 5, and 7, the groove 15 is shaped to provide the operator with a mechanical advantage in mating the connector assemblies 10 in that the groove 15 provides a ramp surface that draws the connector assemblies 10 together as the coupling pin 35 moves toward the hole 17 when the coupling ring 25 is moved to the lock position, in which the coupling pin 35 becomes disposed in the hole 17.

With further reference to FIGS. 2, 3, 5, 7, 8, 10, and 11, the coupling pin 35 of the coupling ring 25 extends through the coupling ring 25 and is biased to extend radially inwardly away from the inner surface of the coupling ring 25 by a flat spring 36 disposed on an outer surface of the coupling ring 25. The flat spring 36 is mounted on the coupling ring 25 by two fasteners 37, such as 4-40 socket head cap screws, that connect the flat spring 36 to the coupling ring 25. A spring cover 32 is disposed on the outer surface of the coupling ring 25 over the flat spring 36 and the outer end of the coupling pin 35. The spring cover 32 protects the flat spring 36 from damage and also serves as an indicator for establishing the orientation of the coupling ring 25 with respect to the release and lock positions. As shown in FIGS. 14A-14C, the spring cover 32 is positioned away from the top/bottom of the body of the connector assembly 10 when the coupling ring 25 is in the release position and directly over the top/bottom of the body when the coupling ring 25 is in the lock position. Further, as shown in FIGS. 1, 6, 9, and 12-14B, the spring cover 32 may be made from aluminum and may be imprinted with text or symbols that provide the operator with instructions for mating and unmating the connector assemblies 10. The spring cover 32 is secured to the coupling ring 25 by fasteners 33, which may carry gaskets (not shown) to seal the connection between the spring cover 32 and the coupling ring 25.

Figure 2:
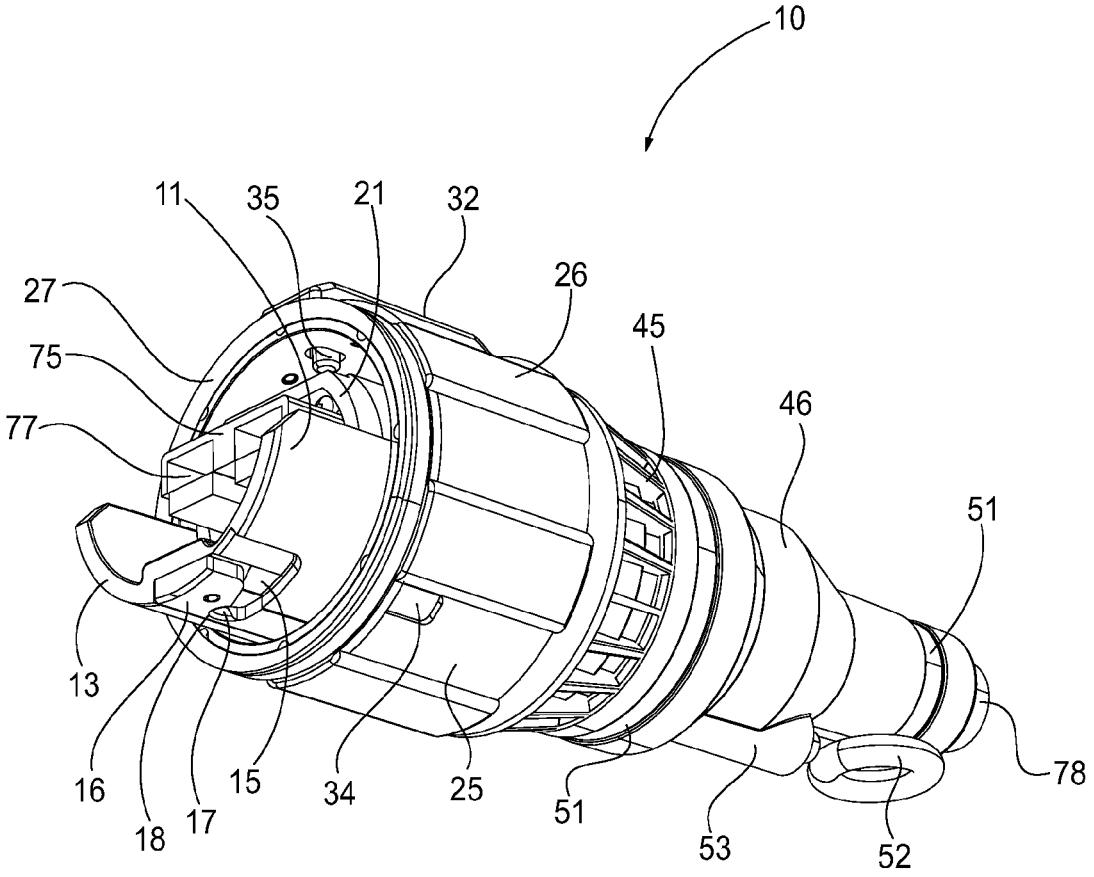
FIG. 2 is a lower perspective view of the assembly of FIG. 1.
Figure 3:
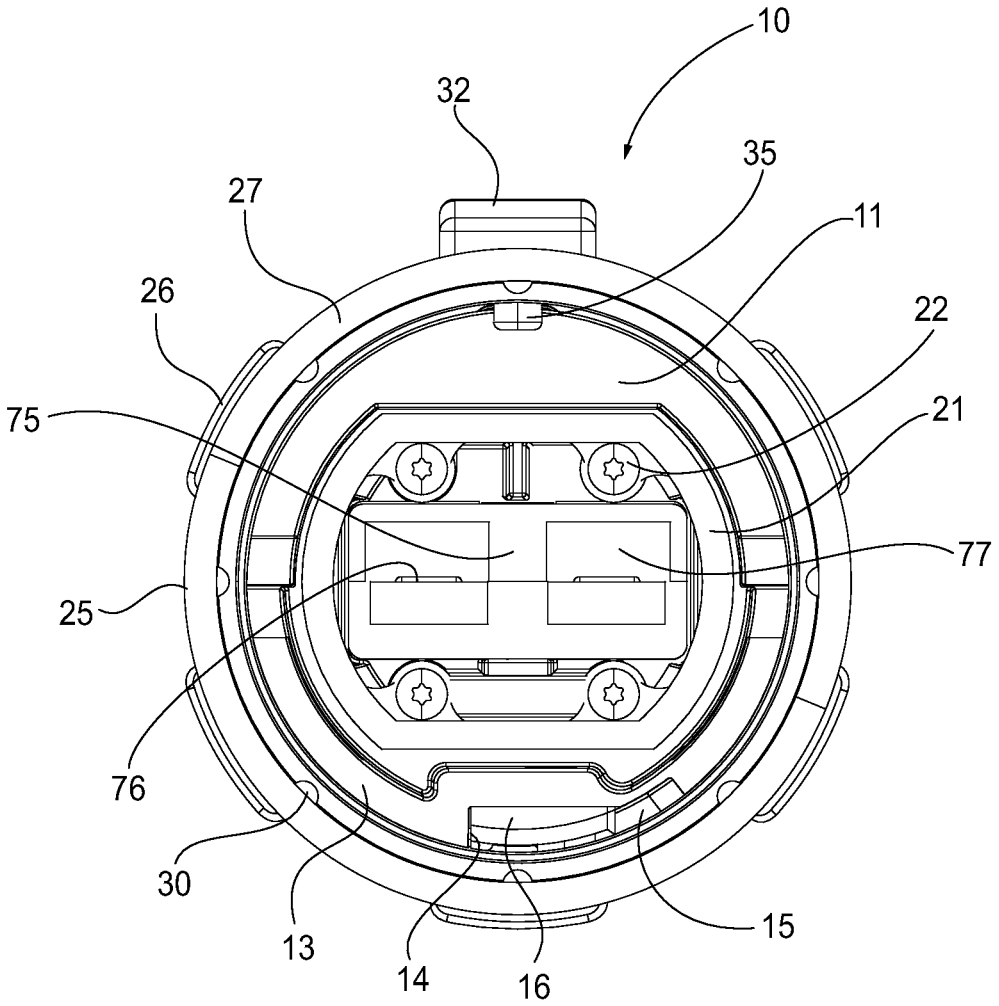
FIG. 3 is a front view of the assembly of FIG. 1.
Figure 4:
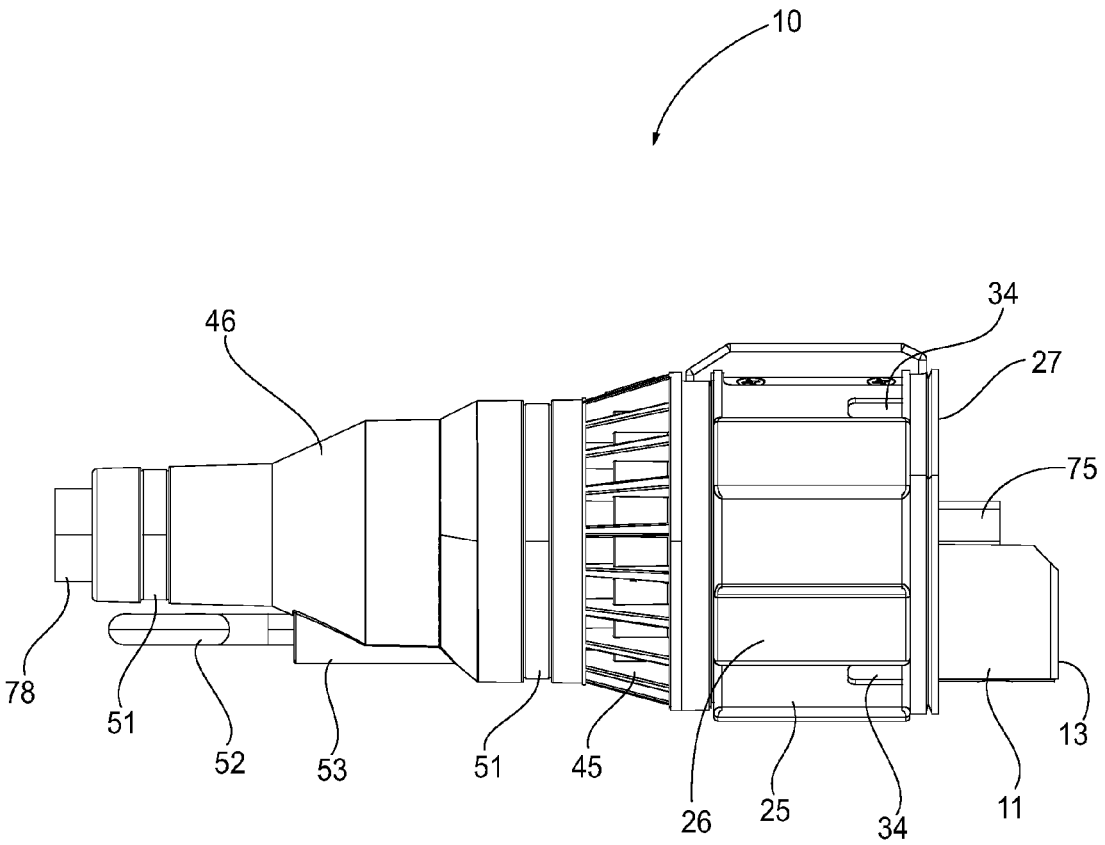
FIG. 4 is a left side view of the assembly of FIG. 1.
Figure 5:
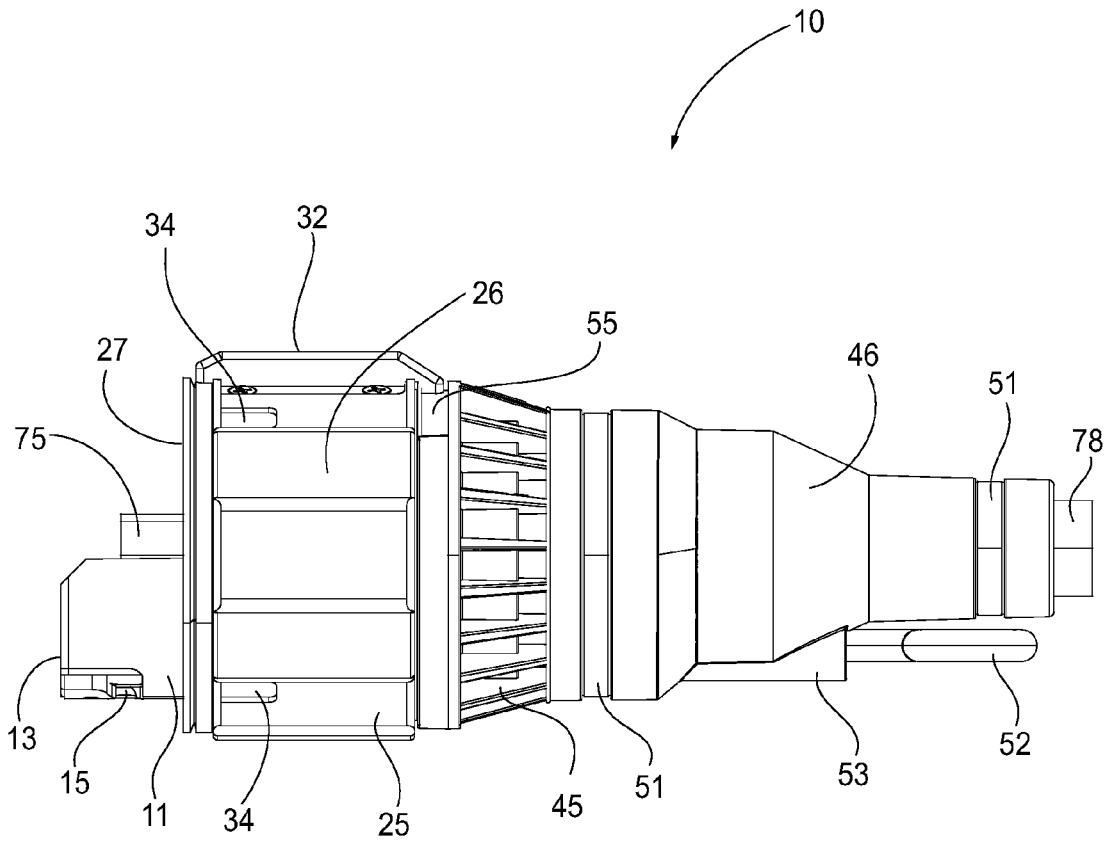
FIG. 5 is a right side view of the assembly of FIG. 1.
Figure 6:
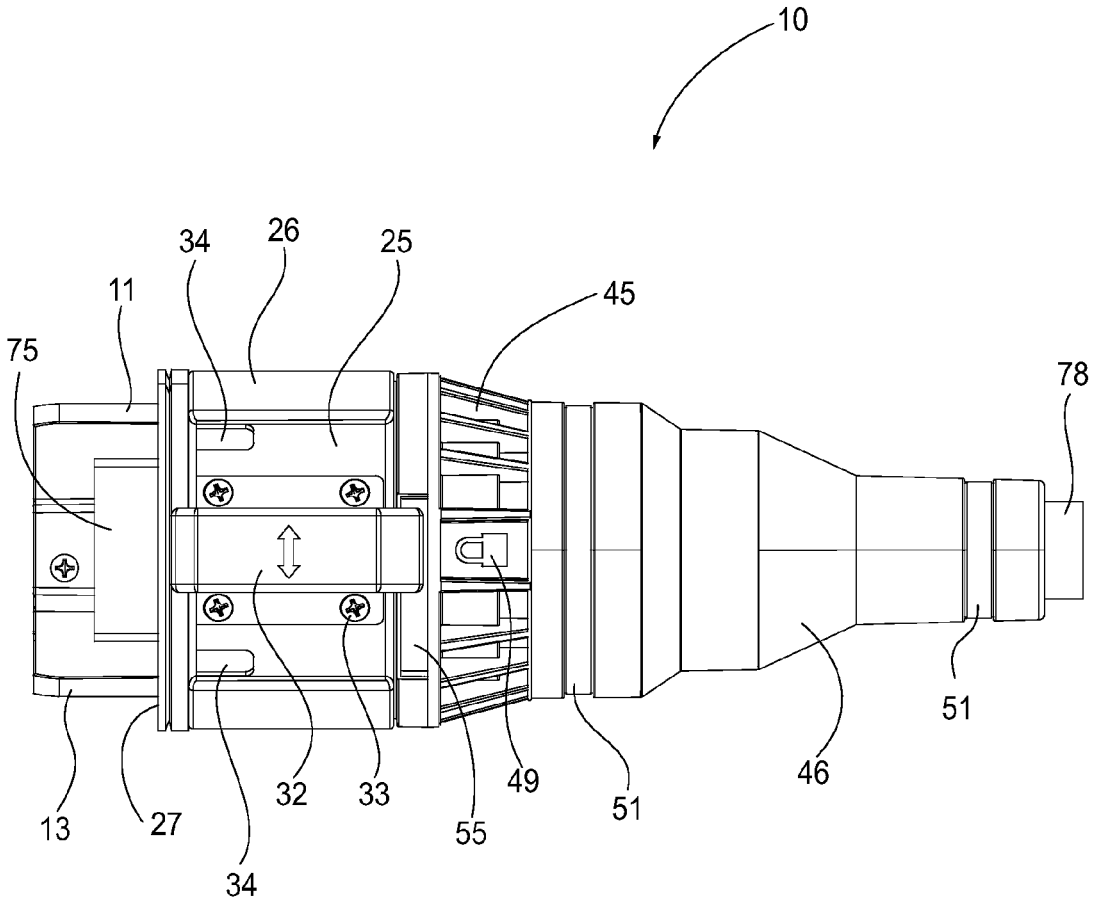
FIG. 6 is a top view of the assembly of FIG. 1.
Figure 7:
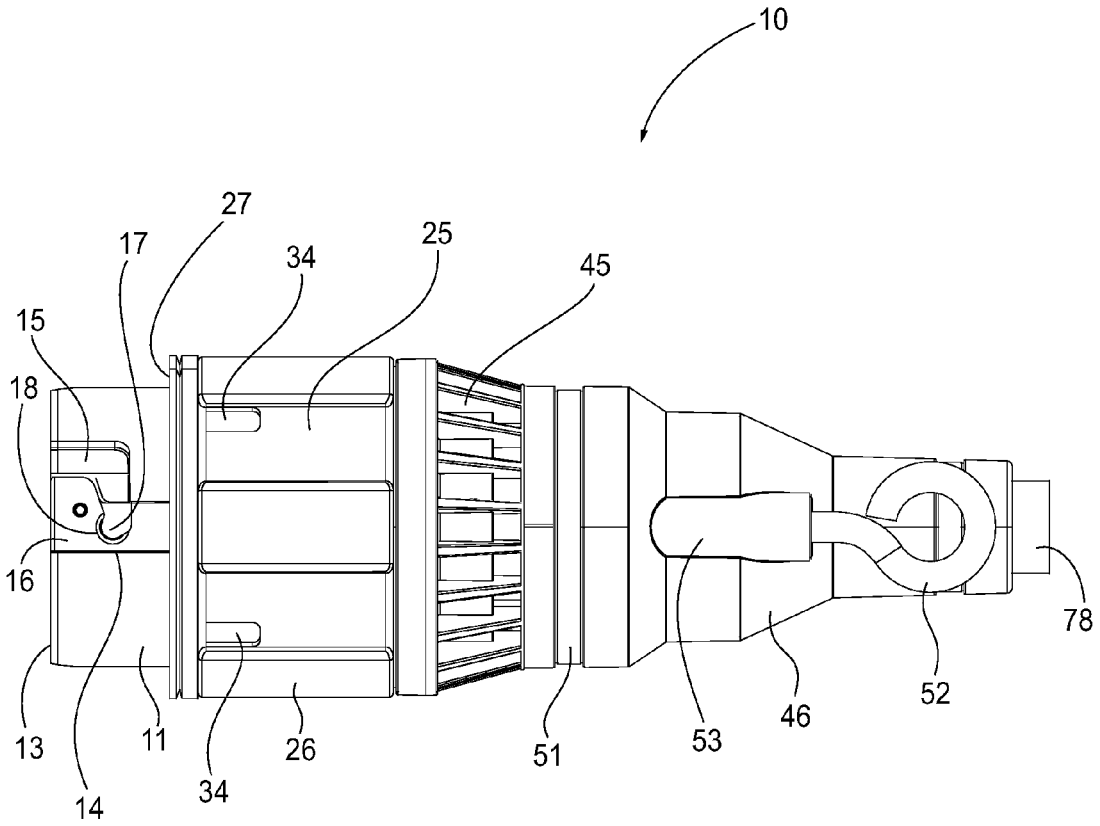
FIG. 7 is a bottom view of the assembly of FIG. 1.

As shown in FIGS. 2 and 7, the hole 17 defined in the connection portion 13/strike plate 16 at the end of the groove 15 has a forward sidewall 18 that extends at a slight angle. According to a particular embodiment or aspect, the sidewall 18 extends at an angle of 10° or approximately 10° with respect to the vertical. The coupling pin 35 is configured to retract toward the inner surface of the coupling ring 25 when engaged with the angled forward sidewall 18 of the hole 17 of the other connector assembly 10 in order to allow the assemblies 10 to be disengaged from each other without moving the coupling rings 25 to the release position when a sufficient force is applied to the connector assemblies 10. When a sufficient force is applied pulling the assemblies 10 apart, the coupling pins 35, which are spring loaded by the flat springs 36, will ride up the angled forward sidewalls 18 of the holes 17 of the respective connection portions 13, thus disengaging the mated connection between the coupling rings 25 and the connection portions 13 to allow the connector assemblies 10 to separate.

According to a particular embodiment or aspect, the angled forward sidewall 18, the coupling pin 35, and the flat spring 36 are so configured that the application of a 150 lb. load or an approximately 150 lb. load applied to the connector assemblies 10 will result in the disengagement of the coupling pins 35 from the holes 17 and the separation of the connector assemblies 10. This disengagement feature is useful and important for car break apart operations that occur in the rail environment. Should adjoining cars separate, the connectors 10 will un-mate without becoming damaged. It is appreciated that this load value may be adjusted according to the intended circumstances of use of the connector assemblies 10. According to a particular embodiment or aspect of the invention, the flat spring 36 is a 17-7 PH stainless steel heat-treated spring and the coupling pin 35 is made from nitronic 60 stainless steel due to the relative corrosion resistance and strength of this material and due to its compatibility with the 304 stainless steel material of the strike plate 16. It is to be appreciated that the materials and configurations of the coupling pin 35 and the flat spring 36 may be adjusted in any manner known to be suitable to those having ordinary skill in the art.

With reference to FIGS. 1-9 and 12-14C, the coupling ring 25 includes an overmolded coating 26 of a suitable polymer material in order to facilitate handling of the assemblies 10 by providing the operator with an improved and more comfortable grip when manipulating the coupling rings 25, particularly in wet conditions. According to a particular embodiment or aspect of the invention, the coupling ring 25 is formed from an aluminum material and the overmolded coating 26 is formed from neoprene material. It is to be appreciated that the materials and configuration of the coupling ring 25 and the overmolded coating 26 may be adjusted in any manner known to be suitable to those having ordinary skill in the art. In addition to facilitating handling of the coupling ring 25, the overmolded coating 26 also provides a seating surface for the spring cover 32 that seals the connection between the spring cover 32 and the coupling ring 25.

As shown in FIGS. 1-9 and 12-14C, the coupling ring 25 also includes a lip seal 27 disposed on the forward end of the coupling ring 25. The lip seal 27 is configured to form a sealing engagement with the lip seal 27 of the coupling ring 25 of the other connector assembly 10 when the connector assemblies 10 are mated together. The lip seals 27 seal all of the mating surfaces of the connectors 10 in order to provide a complete seal of the mated connector assemblies 10. The lip seals 27 are preferably formed from a suitable polymer material so that a low compression force is sufficient to cause the lip seals 27 to deform to the extent to create a sealed engagement when abutted against each other with the coupling rings 25 in the lock position. According to a particular embodiment or aspect, the lip seals 27 are formed from a neoprene material.

As shown in FIGS. 1-3, 8, and 11, the lip seal 27 is removably connected to the forward end of the coupling ring 25. In particular, the lip seal 27 includes a gasket of flexible polymer material, such as neoprene, molded onto a metal, particularly stainless steel, ring. The metal ring includes a plurality of inwardly extending protrusions 28. The coupling ring 25 includes a channel 31 defined therein adjacent to the forward end of the coupling ring 25. The inwardly extending protrusions 28 of the ring of the lip seal 27 are configured to releasably engage the channel 31 to removably connect the lip seal 27 to the coupling ring 25. Particularly, a plurality of cut out portions 30 are defined in the forward end of the coupling ring 25 to selectively open the channel 31 to the forward end of the coupling ring 25. The lip seal 27 is removably connected to the forward end of the coupling ring 25 by aligning the protrusions 28 with the cut out portions 30 and pressing the lip seal 27 onto the forward end of the coupling ring 25 such that the protrusions 28 become engaged within the channel 31. The lip seal 27 is then turned to lock the protrusions 28 in position within the channel 31. The ring of the lip seal 27 also includes an alignment tab 29 extending outwardly. The alignment tab 29 locks into a feature (not shown) built into the spring cover 32, which prevents the lip seal 27 from turning with respect to the coupling ring 25. It is to be appreciated that the materials and the configuration of the lip seal 27 may be adjusted in any manner known to be suitable to those having ordinary skill in the art. In particular, according to one alternative embodiment or aspect, the lip seal 27 is formed integrally with the overmolded coating 26 on the coupling ring 25.

With reference to FIGS. 1-3, 8, and 11, the housing portion 12 of the body also includes a face seal gasket 21 disposed on an end of the housing portion 12 around the power connector 75. The face seal gasket 21 is configured to form a sealing engagement with the face seal gasket 21 of the housing portion 12 of the other connector assembly 10 when the connector assemblies 10 are mated together and the face seal gaskets 21 are brought into an abutting engagement with each other. Similarly to the lip seal 27, the face seal gasket 21 is formed from a suitable polymer material, particularly neoprene, molded onto a metal, particularly stainless steel, ring. The face seal gasket 21 is connected to the housing portion 12 by fasteners 22. The face seal gasket 21 acts as a secondary seal to supplement the seal formed by the lip seal 27, as discussed above, to keep the contacts of the power connector 75 clean and dry, as well as to provide the counterforce necessary to keep the coupling pins 35 in the locked position within the holes 17.

With reference to FIGS. 1, 2, 4-9, and 12-14C, the coupling ring 25 includes at least one indicator that is configured to provide a visual indication of a position of the coupling ring 25 with respect to the release position and the lock position. As indicated above, the spring cover 32 may act as such an indicator. Additionally, the at least one indicator may include a plurality of reflective or differently colored inserts 34 disposed on the coupling ring 25. The plurality of inserts 34 are embedded in the overmolded coating 26 on the coupling ring 25 at regular intervals about the circumference of the coupling ring 25. As shown in FIGS. 14A-14C, the plurality of inserts 34 are configured to align with respective inserts 34 disposed on the other connector assembly 10 when the connector assemblies 10 are fully mated and the coupling rings 25 are in the lock position. Accordingly, the inserts 34 provide the operator with a visual confirmation when the coupling rings 25 are correctly moved into the lock position. The plurality of inserts 34 will be misaligned when the coupling rings 25 are not in the lock position, including in the release position. The inserts 34 will not be aligned unless the coupling rings 25 of both connector assemblies 25 are in the lock position. The inserts 34 have a different color than the color of the overmolded coating 26 and may have a reflective coating to enable the operator to see the inserts better at night with a flashlight. As the overmolded coating 26 and the inserts 34 become dirty through use, the color difference between the overmolded coating 26 and the inserts 34 becomes less noticeable. However, the operator will still be able to discern the inserts 34 because they are recessed within the material of the overmolded coating 26. According to a particular embodiment or aspect, four inserts 34 are provided and evenly spaced around the circumference of the coupling ring 25 so that the inserts 34 can be viewed from any side of the connector assemblies 10. It is to be appreciated that more or fewer inserts 34 can be provided in a manner known to be suitable to those having ordinary skill in the art. It is also to be appreciated that the materials and configuration of the inserts 34 can also be adjusted in any manner known to be suitable to those having ordinary skill in the art.

According to an alternative embodiment or aspect, which is not shown in the drawings, the coupling ring 25 may incorporate detents indicating the release and lock positions. A small pin mounted within the housing portion 12 that is spring-loaded by a spring wire protrudes into the detents formed in the coupling ring 25. The use of the detents gives the operator physical feedback that the coupling ring 25 is in the desired position. Also, the detents can provide an additional locking force for maintaining the coupling ring in the lock position.

Figure 9:
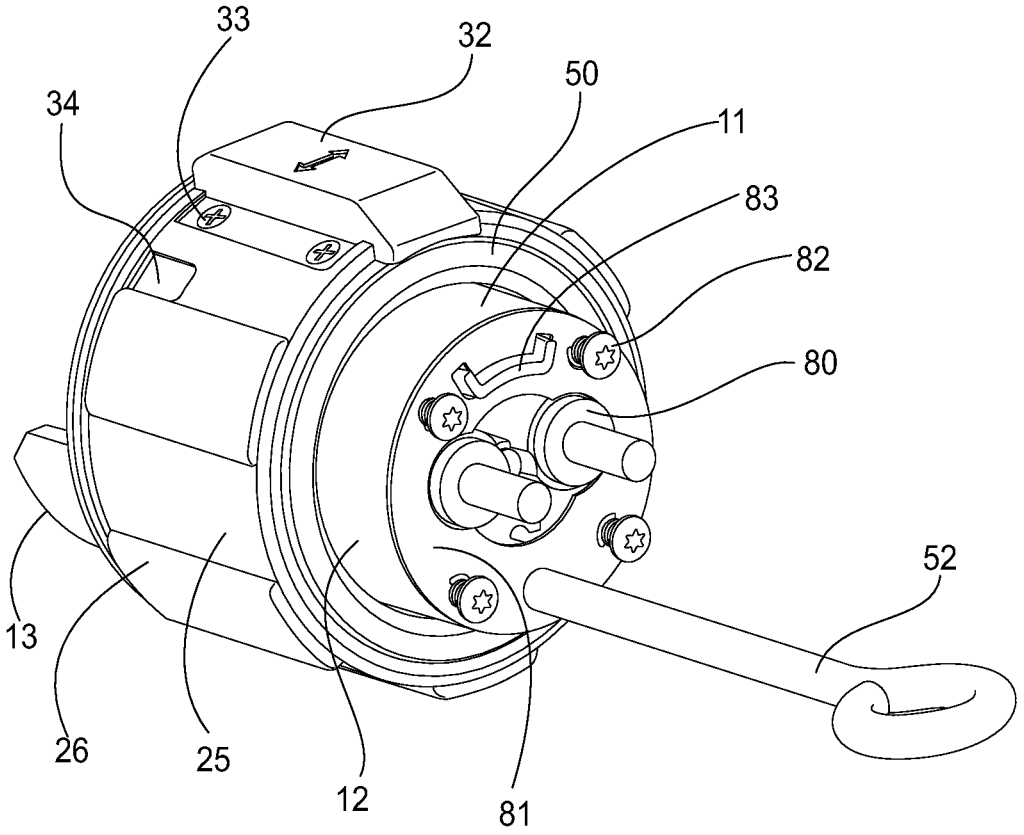
FIG. 9 is a perspective view of portions of the assembly of FIG. 1 illustrating certain interior details of the assembly.
Figure 12:
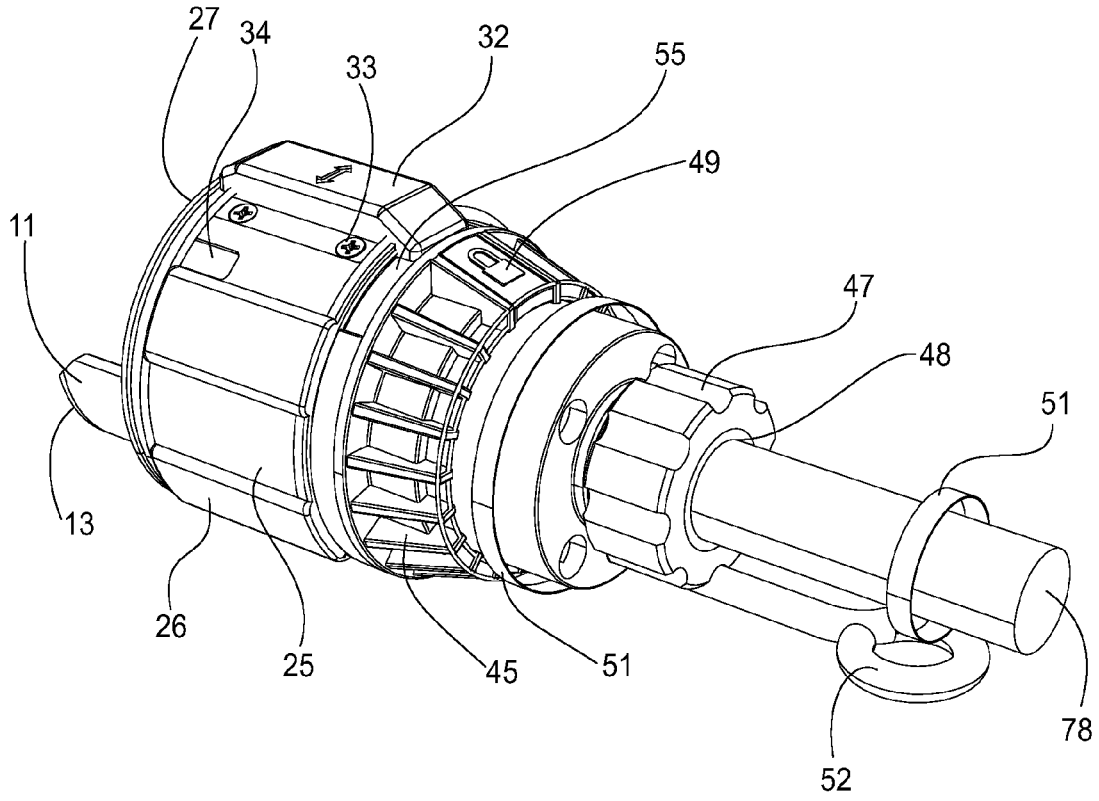
FIG. 12 is a perspective view of the rear of the assembly of FIG. 1 with the rear boot removed to illustrate certain interior details of the assembly.
Figure 13:
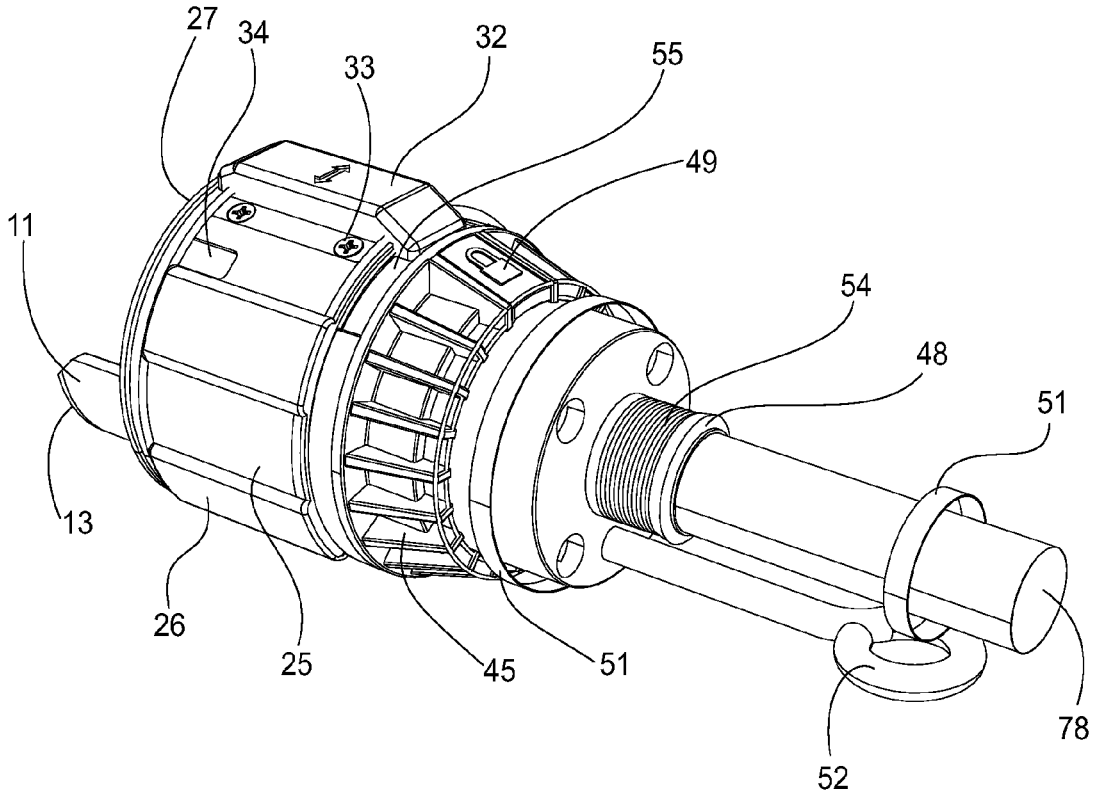
FIG. 13 is a perspective view of the rear of the assembly of FIG. 1 with the rear boot and gland nut removed to further illustrate certain interior details of the assembly.

With reference to FIGS. 1, 2, 4-7, and 12-14C, the rear section 45 of the body is configured to maintain and seal a connection between the power connector 75 and a power cable 78 extending from the rear of the connector assembly 10. The front section 11 and the rear section 45 of the body are fitted together and fastened via fasteners (not shown). The overmolded coating 26 on the coupling ring 25 also provides a seal at the point of connection between the coupling ring 25 and the rear section 45. Additionally, as shown in FIG. 9, a 50 durometer O-ring seal 50 is also provided between the rear section 45 and the front section 11 and coupling ring 25 to seal the connection between the rear section 45 and the coupling ring 25. As shown in FIGS. 12 and 13, the rear section 45 of the body includes a threaded portion 54 at the rear. The power cable 78 passes through the rear section 45 of the body via the threaded portion 54. A gland nut 47, which may be made from aluminum, is threadably secured to the threaded portion 54 around the power cable 78. A gland seal 48, which may be made from neoprene material, is disposed within the gland nut 47 around the power cable 78. Tightening of the gland nut 47 on the threaded portion 54 will compress the gland seal 48 onto the power cable 78 to secure the power cable 78 and seal the rear section 45 at the point where the power cable 78 passes through.

As shown in FIGS. 1, 2, 4-7, and 14A-14C, the rear section 45 also includes a rear boot 46, which may be made from a rubber neoprene material, extending over the power cable 78 and at least a portion of the rear section 45 of the body, as well as the gland nut 47 and the gland seal 48. The rear boot 46 is provided to cover and protect the connection between the power cable 78, the gland nut 47 and gland seal 48, and the rear section 45. The rear boot 46 also helps to secure the power cable 78 to the body by resisting bending of the power cable 78 at the point where the power cable 78 connects to the body. The rear boot 46 extends forwardly over at least a portion of the rear section 45 of the body to provide the rear boot 46 with a more secure anchoring point and to seal the connection between the rear boot 46 and the body. The rear boot 46 is secured in place on the rear section 45 of the body by two metal cable ties 51 wrapped around the rear boot 46.

As shown in FIGS. 1, 5, 6, 12, and 14C, the rear section 45 of the body may also incorporate indicators for indicating the position of the coupling ring 25 on the body. In particular, an indicator/alignment feature 49 in the form of a plastic insert is placed in a corresponding recess in the rear section 45 of the body. The indicator/alignment feature 49 is positioned on the rear section so that the spring cover 32 of the coupling ring 25 is aligned with the feature 49 when the coupling ring 25 is in the lock position. The indicator/alignment feature 49 has a different coloring than the surrounding material of the rear section 45 and may incorporate symbols or writing, such as a padlock symbol, to indicate to the operator that the coupling ring 25 is in the lock position when the spring cover 32 is aligned with the feature 49.

Also, the rear section 45 of the body includes a channel 55 formed at the forward end of the rear section 45 where it meets the coupling ring 25. The channel 55 extends partially around the circumference of the rear section 45 along an angle corresponding to the angle the coupling ring 25 moves through between the lock position and the release position. The rear portion of the spring cover 32 is configured to extend into the channel 55 and move within the channel 55 between the lock position and the release position. In this manner, the relative angular position of the rear portion of the spring cover 32 provides an indication of the angular position of the coupling ring 25 with respect to the lock position and the release position. The topmost end of the channel 55 corresponds to the lock position of the coupling ring 25. The bottommost end of the channel 55 corresponds to the release position of the coupling ring 25. According to an alternative embodiment or aspect, the channel 55 is structured to act as a stop for limiting or preventing rotation of the coupling ring 25 beyond the lock position and the release position by engaging the rear portion of the spring cover 32 at the ends of the channel 55 such that the spring cover 32 cannot move past the ends.

With reference to FIGS. 1, 2, 4, 5, 7, 9, and 11-14C, the body also includes a lanyard pin 52 extending from the rear of the body. As shown, the lanyard pin 52 extends through the rear section 45 of the body and is fastened to the body at the rear of the strike plate 16 in order to securely mount the lanyard pin 52 on the body. The rear boot 46 includes a lower portion 53 that is shaped to accommodate the lanyard pin 52 in order to allow the lanyard pin 52 to extend through the rear boot 46 to the rear section 45 of the body. The lower portion 53 of the rear boot 46 will also provide a seal at the point where the lanyard pin 52 is passed through. The lanyard pin 52 provides an anchoring point for a line, rope, or strap (not shown) to connect the connector assembly 10 to a railcar. In this manner, tension can be applied to the connector assemblies 10 through the lanyard pin 52 rather than through the connection between the body and the power cable 78, and the power cable 78 can be held in a slack condition regardless of the relative movement and position of the railcars. Also, as shown in FIG. 12, the gland nut 47 is formed with notches corresponding in size to the lanyard pin 52. During assembly, the lanyard pin 52 is passed through one of these notches so that the lanyard pin 52 secures the gland nut 47 from turning.

With reference to FIGS. 1-3 and 9-11, the power connector 75 includes flat blade contacts 76 and corresponding recesses 77, which receive the contacts 76 of another power connector 75 in order to establish an electrical coupling between two power connectors 75 due to contact between the flat blade contacts 76 of both power connectors 75. The use of the power connector 75 having flat blade contacts 76 and recesses 77 allows for a hermaphroditic mating connection to be established between the power connectors 75. Additionally, the flat blade contacts 76 are self-cleaning because the contacts scrape away dirt and contaminants as they slide against each other during mating and un-mating of the power connectors 75. Additionally, this configuration of the power connector 75 maintains the polarity of the electrical connection so that the connector assemblies 10 can be utilized in a standard power system where polarity needs to be maintained throughout the connection. According to one particular embodiment or aspect of the invention, the power connector 75 is an Anderson Power Products PSBS50 with finger proof connector contacts, which is rated for 10,000 mating cycles. It is to be appreciated, however, that the power connector 75 may be of any type and configuration known to be suitable to those having ordinary skill in the art.

As shown in FIGS. 9-11, a variety of seals and gaskets are provided for sealing and protecting the rear of the power connector 75 and the wire contacts leading from the power cable 78. In particular, as shown in FIG. 11, the rear of the connector 75 is covered with a gasket 79 and wire seals 80 are provided on each of the individual wire contacts leading from the power cable 78. Additionally, a gasket 81 is provided at the rear of the front section 11, which receives the wire contacts and wire seals 80 to seal the rear of the front section 11 and the passage of the wire contacts into the front section 11. An alignment protrusion 83 extends from the rear of the front section 11. The alignment protrusion 83 corresponds to a similarly shaped aperture in the gasket 81 so that the gasket 81 is assembled onto the front section 11 in the correct orientation. The gasket 81 is secured to the rear of the front section 11 by fasteners 82 and/or an adhesive backing (not shown). The gaskets 79, 81 and wire seals 80 may be formed from a neoprene material. It is to be appreciated that the number, configuration, and construction of the gaskets 79, 81 and wire seals 80 may be altered in any manner known to be suitable to those having ordinary skill in the art.

With reference to FIGS. 1-7 and 14A-14C, a method of coupling electrical power connector assemblies 10 is provided in accordance with a preferred and non-limiting embodiment or aspect of the invention. The method includes providing at least two electrical power connector assemblies 10, as described above. The coupling rings 25 are moved to the release position and the connector assemblies 10 are aligned such that the connection portions 13 are oriented in opposite directions, one above the other, as shown in FIG. 14A. The connector assemblies 10 are then pressed together such that the coupling ring 25 of each connector assembly 10 engages the connection portion 13 of the other connector assembly 10 and the connection portion 13 of each of the connector assemblies 10 is engaged by the coupling ring 25 of the other connector assembly 10.

As shown in FIG. 14B, the connector assemblies 10 are slid together until they stop with an approximately 0.1 inch gap between the lip seals 27. At this time, the coupling pins 35 of the coupling rings 25 have slid into and engaged the grooves 15 of the respective connection portions 13. Also, the contacts 76 of the power connectors 75 are slid within the respective recesses 77 and in contact with each other. Each of the coupling rings 25 is then rotated to the lock position such that the coupling pins 35 slide through the respective grooves 15 to engage within the holes 17 of the respective connection portions 13 in order to matingly engage the coupling rings 25 with the respective connection portions 13 and bring the power connectors 75 together to complete the mating engagement between the power connectors 75. It is to be appreciated that the coupling rings 25 do not need to be precisely in the release position in order to mate the connector assemblies 10. Rather, once the connector assemblies 10 are slid together as described above, the coupling rings 25 can be rotated to the release position to engage the coupling pins 35 within the respective grooves 15 and then rotated to the lock position.

As shown in FIGS. 14A-14C, the plurality of inserts 34 in the coupling rings 25 become aligned when the coupling rings 25 are moved to the lock position. Additionally, the spring covers 32 become disposed on opposite sides of the mated assemblies 10 and aligned with the indicator/alignment features 49 in the rear sections 45. Also, as shown, the coupling rings 25 are rotated counterclockwise and opposite to each other to mate the connector assemblies 10.

To un-mate the connector assemblies 10, the coupling rings 25 are rotated clockwise and opposite to each other such that the coupling pins 35 slide out of the holes 17 and into the grooves 15 of the respective connection portions 13, and the inserts 34 as well as the spring covers 32 and indicator/alignment features 49 become misaligned. The connector assemblies 10 can then be pulled apart to disengage the coupling rings 25 from the respective connector assemblies 10.

Figure 15:
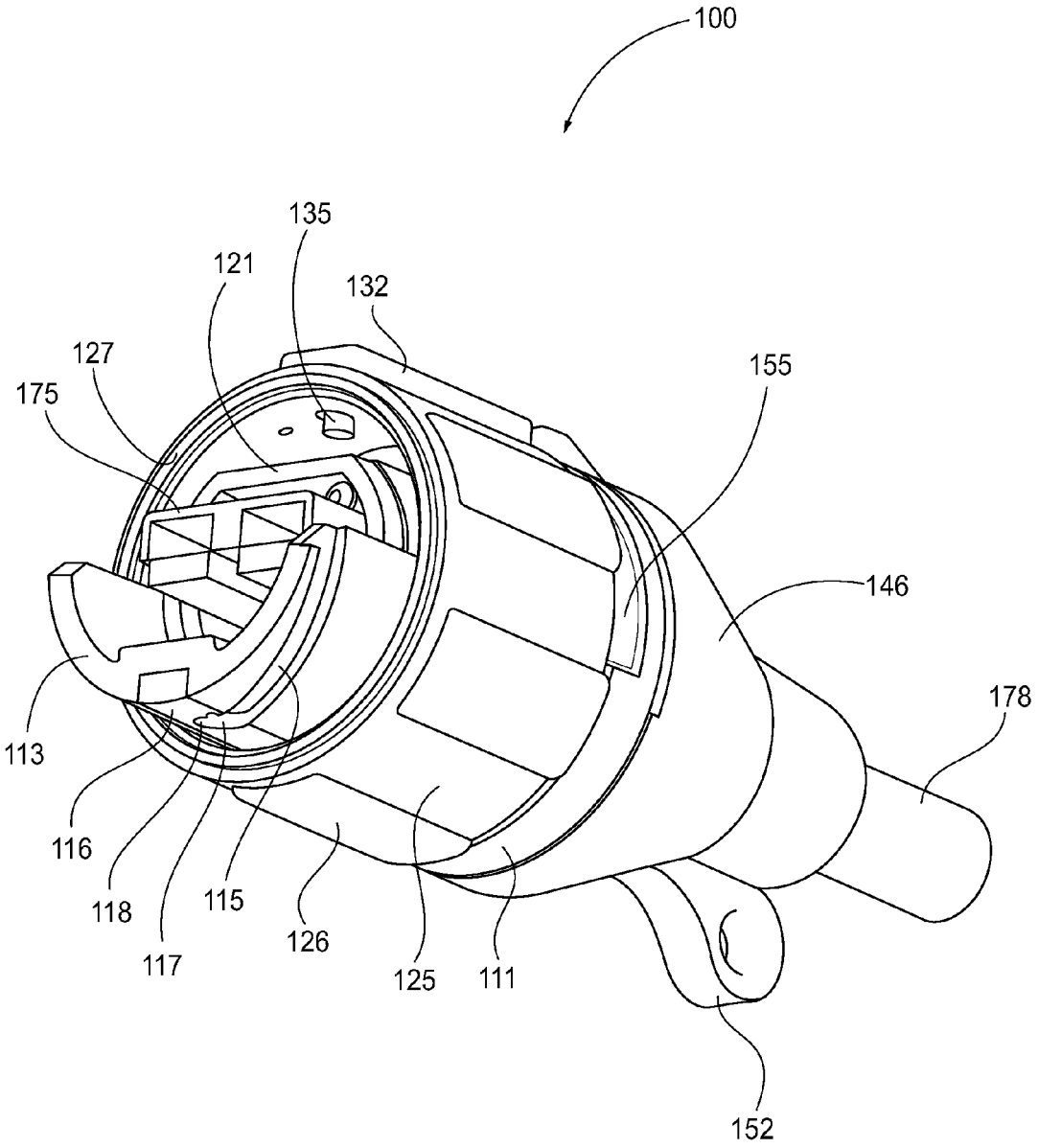
FIG. 15 is a lower perspective view of another electronic power connector assembly according to the principles of the present invention.
Figure 16:
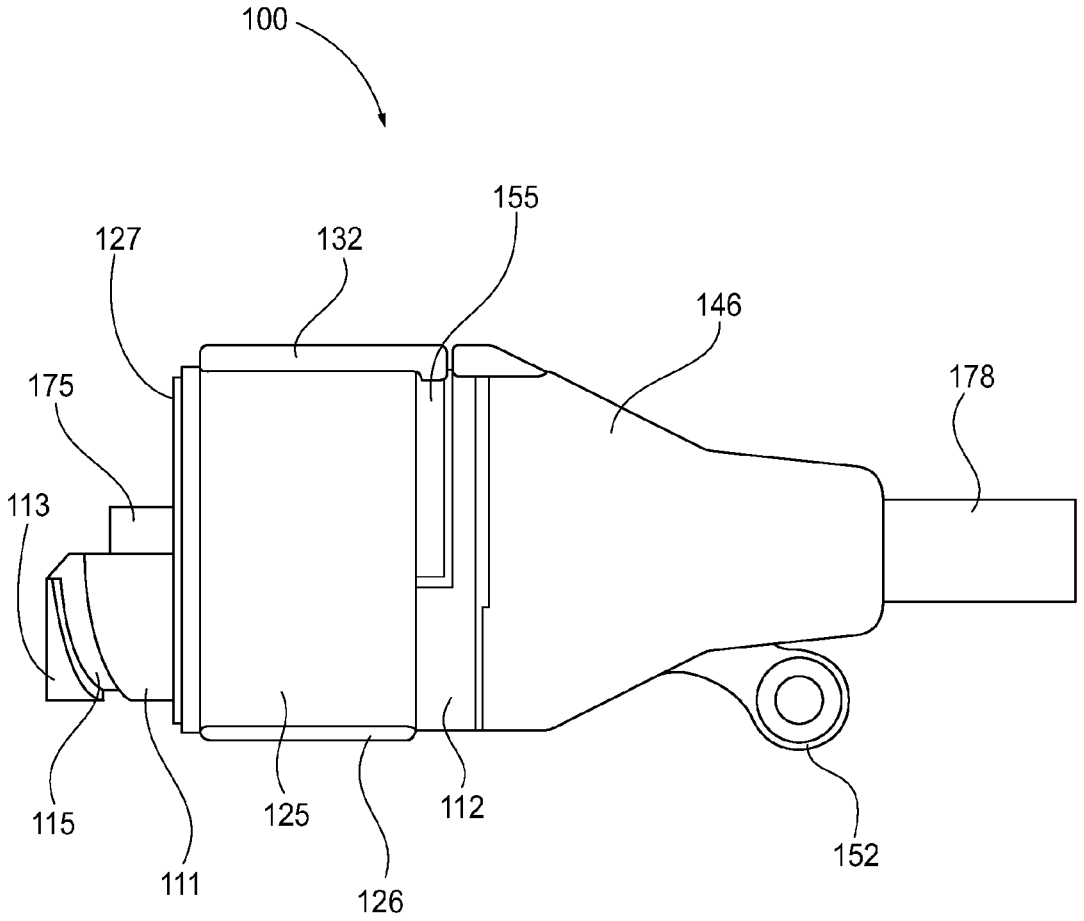
FIG. 16 is a right side view of the assembly of FIG. 15.
Figure 17:
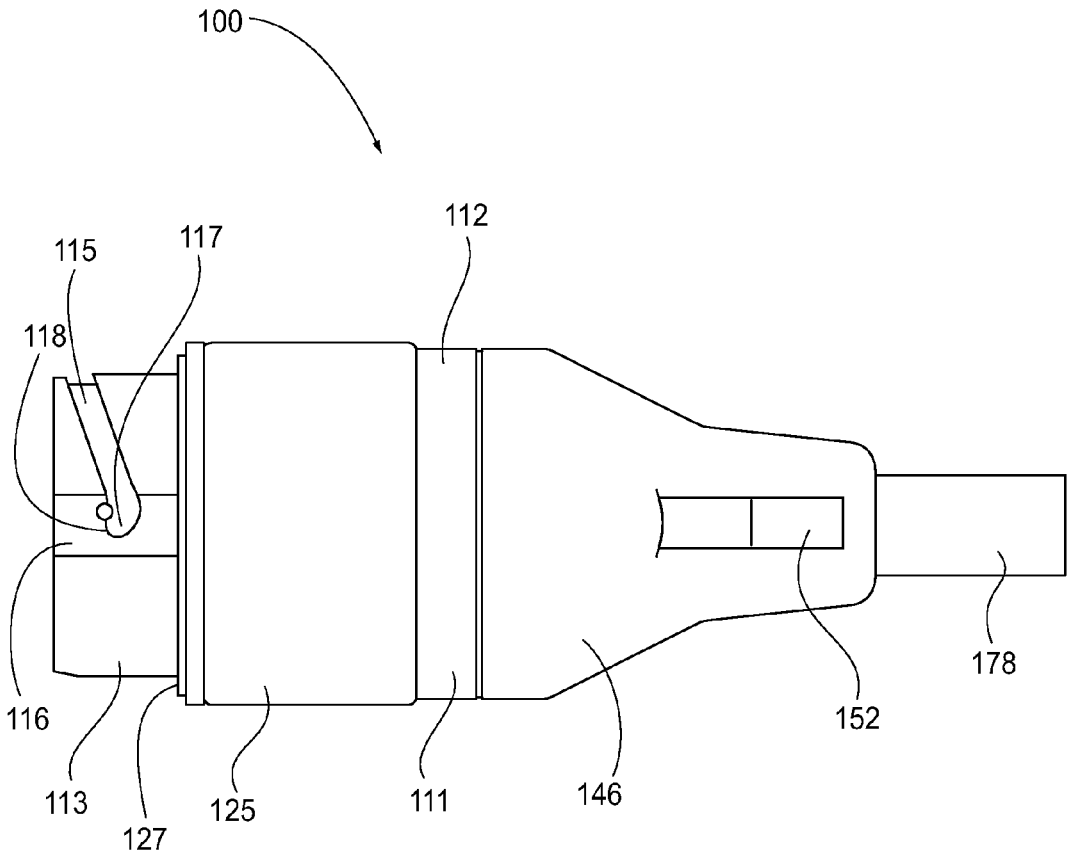
FIG. 17 is a bottom view of the assembly of FIG. 15.

With reference to FIGS. 15-17, another preferred and non-limiting embodiment or aspect of an electrical power connector assembly 100 in accordance with the principles of the present invention is shown. The connector assembly 100 shown in FIGS. 15-17 is similar to the connector assembly 10 described above with reference to FIGS. 1-14C in both construction and operation. In particular, the connector assembly 100 includes a body 111 having a housing portion 112 for housing a power connector 175 and a connection portion 113. The power connector 175 is of the same type as the power connector 75 described above. The assembly 100 includes a coupling ring 125 rotatably disposed on the body 111 between a lock position and a release position. The coupling ring 125 engages the connection portion 113 of another connector assembly 100 in a bayonet-style coupling arrangement to secure two connector assemblies 100 in a mating engagement. Specifically, the coupling ring 125 includes a spring-loaded coupling pin 135 that engages a groove 115 defined in the connection portion 113. The groove 115 extends 90° from a top edge of the connection portion 113 and extends in a slightly curved/helical manner so as to draw the connector assemblies 100 together as the coupling pins 135 of the coupling rings 125 slide within the respective grooves 115. It also allows the coupling rings 125 to help disengage the connector assemblies 100 when moved to the open position, giving the operator a mechanical advantage to disengage the connector assemblies 100.

The groove 115 extends through the strike plate 116 of the body and terminates in a hole 117 defined in the strike plate 116. The coupling pin 135 of the other connector assembly 100 becomes disposed within the hole 117 when the coupling ring 125 is in the lock position. The hole 117 includes an angled front wall 118 to allow the connector assemblies 100 to be pulled apart upon application of sufficient force to the connector assemblies 100, as described above.

The coupling ring 125 includes an overmolded coating 126, as described above, and a lip seal 127 disposed on the forward end of the coupling ring 125. According to this embodiment or aspect, the lip seal 127 is formed integrally with the overmolded coating 126. When the connector assemblies 100 are in the mated condition, the lip seals 127 of the coupling rings 125 will engage each other to seal the connector assemblies 100.

The housing portion 112 of the body 111 also includes a face seal gasket 121 disposed around the power connector 175. When the connector assemblies 100 are in the mated condition, the face seal gaskets 121 of the housing portions 112 will engage each other to form a seal around the mated power connectors 175.

The coupling ring 125 also includes a spring cover 132 disposed on the coupling ring 125 over the flat spring (not shown) for spring loading the coupling pin 135. The spring cover 132 also serves as an indicator for establishing the relative rotational position of the coupling ring 125 on the body 111. In particular, the spring cover 132 may incorporate text or symbols indicating to the operator how the connector assembly 100 is to be used. The body 111 of the connector assembly 100 also includes a channel 155 formed behind the coupling ring 125 that receives a rear portion of the spring cover 132 to indicate the relative position of the coupling ring 125 with respect to the lock position and the release position. The ends of the channel 155 may also form rotation stops for limiting or preventing rotation of the coupling ring 125 past the lock position and the release position by engaging the rear portion of the spring cover 132.

The connector assembly 100 also includes a rear overmolded body 146 disposed over the rear of the body 111 for securing and sealing the connection between a power cable 178 and the rear of the body 111. The connector assembly 100 further includes a lanyard connection 152, which is configured to connect a line, rope, or strap to the body 111. The lanyard connection 152 is formed as a rearward part of the strike plate 116 and extends through the rear overmolded body 146.

It is to be understood that the invention may assume various alternative variations and step sequences, except where expressly specified to the contrary. It is also to be understood that the specific devices and processes illustrated in the attached drawings, and described in the specification, are simply exemplary embodiments or aspects of the invention. Although the invention has been described in detail for the purpose of illustration based on what is currently considered to be the most practical and preferred embodiments or aspects, it is to be understood that such detail is solely for that purpose and that the invention is not limited to the disclosed embodiments or aspects, but, on the contrary, is intended to cover modifications and equivalent arrangements that are within the spirit and scope thereof. For example, it is to be understood that the present invention contemplates that, to the extent possible, one or more features of any embodiment or aspect can be combined with one or more features of any other embodiment or aspect.

What is claimed is:

1. An electrical power connector assembly, comprising:

a body comprising a housing portion and a connection portion;

a coupling ring rotatably disposed on the body; and a power connector disposed within the housing portion of the body, the power connector being configured to form a mating engagement with another power connector having the same configuration, wherein the coupling ring is configured to engage a connection portion of another electrical power connector assembly having the same configuration and the connection portion of the body is configured to be engaged by a coupling ring of the other electrical power connector assembly having the same configuration, and wherein the coupling ring and the connection portion of the body are configured to engage the connection portion of the body and the coupling ring of the other electrical power connector assembly, respectively, to bring the power connector together with the power connector of the other electrical power connector assembly to complete the mating engagement between the power connectors.

2. The electrical power connector assembly according to claim 1, wherein the coupling ring is rotatable on the body between a release position in which the coupling ring is configured to allow the connection portion of the other electrical power assembly to be disengaged from the coupling ring and a lock position in which the coupling ring is configured to lock the connection portion of the other electrical power connector assembly in engagement with the coupling ring.

3. The electrical power connector assembly according to claim 2, wherein the coupling ring includes a coupling pin extending from an inner surface thereof and the connection portion includes a groove defined therein, wherein the coupling pin of the coupling ring is configured to slidingly engage the groove of the connection portion of the other electrical power connector assembly to bring the power connector together with the power connector of the other electrical power connector assembly as the coupling ring is moved from the release position to the lock position to complete the mating engagement between the power connectors.

4. The electrical power connector assembly according to claim 3, wherein the coupling pin of the coupling ring is biased to extend radially inwardly away from the inner surface of the coupling ring, and the groove of the connection portion of the body terminates in a hole having an angled sidewall, and wherein the coupling pin is configured to retract toward the inner surface of the coupling ring when engaged with the angled sidewall of the hole of the other electrical power connector assembly to allow the electrical power connector assembly to be disengaged from the other electrical power connector assembly without moving the coupling ring to the release position.

5. The electrical power connector assembly according to claim 4, wherein the coupling ring further comprises a flat spring for biasing the coupling pin, the flat spring being disposed on an outer surface of the coupling ring, and a cover disposed on the outer surface of the coupling ring over the flat spring.

6. The electrical power connector assembly according to claim 2, wherein the coupling ring includes at least one indicator configured to provide a visual indication of a position of the coupling ring with respect to the release position and the lock position.

7. The electrical power connector assembly according to claim 6, wherein the at least one indicator comprises a plurality of reflective inserts disposed on the coupling ring, and wherein the plurality of reflective inserts are configured to align with respective reflective inserts disposed on the coupling ring of the other electrical power connector assembly when the coupling ring is in a lock position.

8. The electrical power connector assembly according to claim 2, wherein the body includes a rotation stop to limit rotation of the coupling ring on the body past the release position and the lock position.

9. The electrical power connector assembly according to claim 1, wherein the coupling ring includes a lip seal disposed on an end thereof, and wherein the lip seal is configured to form a sealing engagement with the lip seal of the coupling ring of the other electrical power connector assembly.

10. The electrical power connector assembly according to claim 9, wherein the lip seal is removably connected to the coupling ring.

11. The electrical power connector assembly according to claim 10, wherein the lip seal comprises a gasket molded on a ring having inwardly extending protrusions and the coupling ring includes a channel defined adjacent to the end thereof, and wherein the protrusions of the ring of the lip seal are configured to releasably engage the channel to removably connect the lip seal to the coupling ring.

12. The electrical power connector assembly according to claim 1, wherein the housing portion of the body includes a face seal gasket disposed on an end of the housing portion of the body around the power connector, and wherein the face seal gasket is configured to form a sealing engagement with the face seal gasket of the housing portion of the body of the other electrical power connector assembly.

13. The electrical power connector assembly according to claim 1, wherein the coupling ring is disposed on the body in a position surrounding at least a portion of the housing portion of the body.

14. The electrical power connector assembly according to claim 13, wherein the connection portion of the body extends from the housing portion and has a crescent shape corresponding to a shape of the coupling ring.

15. The electrical power connector assembly according to claim 1, wherein the coupling ring comprises an overmolded polymer coating configured to facilitate handling of the coupling ring.

16. The electrical power connector assembly according to claim 1, wherein the body further comprises a rear section configured to maintain and seal a connection between the power connector and a power cable extending from a rear of the electrical power connector assembly.

17. The electrical power connector assembly according to claim 16, wherein the rear section comprises a nut and a gland seal disposed within the nut, the nut and gland seal being configured to secure the power cable to the body.

18. The electrical power connector assembly according to claim 17, wherein the rear section further comprises a rear boot extending over at least a portion of the body, the nut, and the gland seal.

19. An electrical power connection system, comprising:

at least two substantially identical electrical power connector assemblies, each assembly comprising:

a body comprising a housing portion and a connection portion;

a coupling ring rotatably disposed on the body; and a power connector disposed within the housing portion of the body, wherein the power connectors are substantially identical and each of the power connectors is configured to form a mating engagement with the other, wherein the coupling ring of each of the electrical power connector assemblies is configured to engage the connection portion of the other electrical power connector assembly and the connection portion of each of the electrical power connector assemblies is configured to be engaged by the coupling ring of the other electrical power connector assembly, and wherein the coupling rings of both electrical power connector assemblies matingly engage the respective connection portions to bring the power connectors together to complete the mating engagement between the power connectors.

20. A method of coupling electrical power connector assemblies, comprising:

providing at least two substantially identical electrical power connector assemblies, each assembly comprising:

a body comprising a housing portion and a connection portion;

a coupling ring rotatably disposed on the body, the coupling ring being rotatable on the body to a lock position; and a power connector disposed within the housing portion of the body, wherein the power connectors are substantially identical and each of the power connectors is configured to form a mating engagement with the other;

aligning the at least two electrical power connector assemblies and pressing them together such that the coupling ring of each of the electrical power connector assemblies engages the connection portion of the other electrical power connector assembly and the connection portion of each of the electrical power connector assemblies is engaged by the coupling ring of the other electrical power connector assembly; and rotating each of the coupling rings to the lock position to matingly engage the coupling rings with the respective connection portions to bring the power connectors together to complete the mating engagement between the power connectors.

* * * * *